US011891861B2

(12) United States Patent
Stenshorne et al.

(10) Patent No.: US 11,891,861 B2
(45) Date of Patent: Feb. 6, 2024

(54) MULTI-MODE PUMPED RISER ARRANGEMENT AND METHODS

(71) Applicant: Enhanced Drilling AS, Straume (NO)

(72) Inventors: Per Christian Stenshorne, Oslo (NO); David Edward Smith, Katy, TX (US); Gustav Olov Skärgård, Oslo (NO)

(73) Assignee: Enhanced Drilling AS, Straume (NO)

( * ) Notice: Subject to any disclaimer, the term of this patent is extended or adjusted under 35 U.S.C. 154(b) by 0 days.

(21) Appl. No.: 17/770,510

(22) PCT Filed: Oct. 30, 2020

(86) PCT No.: PCT/NO2020/050266

§ 371 (c)(1),
(2) Date: Apr. 20, 2022

(87) PCT Pub. No.: WO2021/086200

PCT Pub. Date: May 6, 2021

(65) Prior Publication Data

US 2022/0389770 A1 Dec. 8, 2022

(30) Foreign Application Priority Data

Oct. 30, 2019 (NO) ..... 20191299

(51) Int. Cl.
*E21B 17/01* (2006.01)
*E21B 21/00* (2006.01)
*E21B 21/08* (2006.01)

(52) U.S. Cl.
CPC ..... *E21B 17/01* (2013.01); *E21B 21/001* (2013.01); *E21B 21/082* (2020.05)

(58) Field of Classification Search
CPC ..... E21B 17/01; E21B 21/001; E21B 21/08; E21B 21/082
See application file for complete search history.

(56) References Cited

U.S. PATENT DOCUMENTS 9,222,320 B2 12/2015 Varpe
9,670,744 B1 * 6/2017 Stave ..... E21B 17/01
(Continued)

FOREIGN PATENT DOCUMENTS

GB 2502626 A 12/2013
GB 2520533 A 5/2015
(Continued)

OTHER PUBLICATIONS

Statoil, "MPD Toolbox for Floating Drilling Units", Research Disclosure Database No. 593041, Sep. 2013.
(Continued)

*Primary Examiner* — Matthew R Buck
(74) *Attorney, Agent, or Firm* — Bradley Arant Boult Cummings LLP

(57) ABSTRACT

The present invention relates to a riser system in the form of a pumped riser (1), i.e. a riser (1) having an outlet (6) from the riser (1) at a depth below the surface (S) of a body of water, where the outlet (6) is coupled to a return pump (7) to return fluid from the riser (1) to the surface (S), and various operational methods to facilitate greater versatility when performing hydrocarbon drilling related operations. The arrangement also comprises a sealing element (15, 16) to seal an annulus (5) of the riser (1), and a by-pass (17) around the sealing element (15, 16). Various methods makes it possible to switch between open mode and closed mode, and vice versa, monitoring leakage across the sealing element (15, 16), as well as performing other operations exploiting the advantages of the two different modes.

9 Claims, 7 Drawing Sheets

(56) References Cited

U.S. PATENT DOCUMENTS

| | | | | |
|---|---|---|---|---|
| 10,724,315 | B2 * | 7/2020 | Leuchtenberg | E21B 21/001 |
| 2003/0066650 | A1 | 4/2003 | Fontana et al. | |
| 2015/0252637 | A1 * | 9/2015 | Leuchtenberg | E21B 21/001 175/5 |
| 2018/0179827 | A1 * | 6/2018 | Stave | E21B 21/08 |
| 2019/0055791 | A1 | 2/2019 | Barela | |

FOREIGN PATENT DOCUMENTS

| | | | |
|---|---|---|---|
| GB | 2525396 | A | 10/2015 |
| WO | WO-2013055226 | A1 | 4/2013 |
| WO | WO-2016135480 | A1 | 9/2016 |
| WO | WO-2017115344 | A2 | 7/2017 |
| WO | WO-2017195175 | A2 | 11/2017 |
| WO | WO-2018231729 | A1 | 12/2018 |
| WO | WO-2019014428 | A1 | 1/2019 |
| WO | WO-2019033126 | A1 | 2/2019 |

OTHER PUBLICATIONS

Godhavn. J.-M. et. al. "Development and First Use of Controlled Mud Level System in US Deepwater GoM". SPE/IADC-173814-MS. 2015.

Wigernes, Knut; International Search Report, PCT/NO2020/050266, dated Feb. 12, 2021, 6 pages.

Godhavn. J.-M. et al. "How to Apply Controlled Mud Level Systems in Deep Water Drilling". SPE/IADC-179180-MS. 2016.

Sharifur, Rahman et. al. "Successful Testing of Single Gradient Subsea MudLift Drilling Technology in Deep Water Gulf of Mexico". SPE/IADC-174881-MS. 2015.

Godhavn. J.-M. et. al. "ECD Management Toolbox for Floating Drilling Units". OTC 25292-MS. 2014.

Dowall, David, Dual Gradient Drilling The System, DEA Presentation, Jun. 23, 2011. Retrieved from the Internet: <https://fdocuments.net/reader/full/dual-gradient-drilling>.

Piccolo, Brian, Subsea Pump System—Optimized for Rapid Deployment & Operation within the Primary Barrier, AFGlobal Corporation, 2016. Retrieved from the Internet: <https://www.iadc.org/wp-content/uploads/2017/09/Brian-Piccolo-Afglobal-Corp.pdf>.

* cited by examiner

MULTI-MODE PUMPED RISER ARRANGEMENT AND METHODS

TECHNICAL FIELD

The present invention relates to a riser system and various operational methods to facilitate greater versatility when performing hydrocarbon drilling related operations near or at a bottom of a body of water.

More specifically, the invention relates to a so-called pumped riser, i.e. a riser having an outlet from the riser at a depth below the surface of the body of water, where the outlet is coupled to a return pump to return drilling fluid from the riser to the surface.

BACKGROUND ART

Pumped riser operations can be of the closed type, which means that the annulus of the riser is closed by a sealing element above the outlet to a return pump and that the pump is able to regulate the wellbore pressure by (rapidly) changing the pressure at the riser outlet by changing the pressure at the inlet of the return pump.

Pumped riser operations can also be of the open type, which means that the annulus of the riser is open to atmosphere and that the top of the riser is at approximately atmospheric pressure. The return pump of such a system also adjusts the pressure at this outlet of the riser which is given by the level of liquid, such as mud, in the riser in order to regulate the wellbore pressure. Such systems are sometimes referred to as CML (Controlled Mud Level) and have proven to have multiple benefits operating with a riser level below the slip joint during the drilling process, but also during other phases of well-construction, completion, production or abandonment.

Detecting influxes as early as possible is one of the most critical elements of the drilling process, as an influx that gets out of control could have fatal consequences. Any method that allows the driller to identify a small an influx as early as possible, and the ability to quickly respond to it is therefore of great interest to the industry.

Further, when operating in closed mode, drilling fluid volume control relies on observing flow measurements over time and combining these measurements with volume measurements of drilling fluid in the drilling rig's active system. All these measurements are associated by measurement uncertainties related to the accuracy and repeatability of the sensor measurement. This is also true for measurements done under static conditions in closed mode. Alternatively, the system could be connected to the topside trip tank and flow measurements combined with trip tank measurements could be used to determine the volume. With the first alternative, the total volume error increases with time. With the second alternative, the trip tank measurement accuracy is affected by rig motion, and the accuracy of the trip tank volume sensors. In addition, the lines bringing the drilling fluid to and from the trip tank are not full of mud at all times, which also causes uncertainty to the total volume measurements.

On the other hand, with CML in static conditions (i.e. when not circulating), it is possible to isolate the riser and use it as a tank to monitor the wellbore for changes in drilling fluid volume. Using the pressure sensors (which are generally very accurate) or other accurate methods for determining liquid/gas (air or other gas) interface, makes is possible to monitor the volume in the riser and thereby use this as a very accurate method for determining any changes in well fluid volume (influx, loss, temperature effects, wellbore breathing or other). In such a system there are no lines with any void and all volume is measured very accurately at all times. Also, with the liquid level below the slip-joint, the volume measurement is not affected by the change in volume of the riser due to the change in slip joint length associated with rig motion.

In regular drilling operations with a closed riser according to prior art (i.e. with some form of sealing element in the riser), the riser above the sealing element is full. The differential pressure across the sealing element is dictated by static pressure of a full riser above the sealing element (Although this will be affected by slip joint motion) and the operating pressure below the sealing element. With a given mud weight and setting depth of the sealing element, there is no way of actively controlling the pressure above the sealing element. The differential pressure across the sealing element will affect wear and thus lifetime of the sealing element. The pressure above the sealing element together with the pressure rating of the sealing element will also dictate the minimum allowable pressure below the sealing element.

The leakage rate across a sealing element in the riser at a given differential pressure across the sealing element can be an indication of the wear status. Some sealing elements also use methods for a variable pressure/force acting radially on the sealing element. In such cases the leakage will vary with wear, pre-charge/force and potentially other factors. At any rate, for a given set of the rest of the parameters, the leakage rate at a given differential pressure across the sealing element can be an indication, or in some cases can be correlated to, the actual wear and thus the remaining lifetime. With a riser full to surface (to the bell-nipple), affected by varying volume associated with the slip-joint motion, it is difficult to measure the leakage rate accurately.

Also, the motion of the slip joint means that there is not a constant height from top of liquid level to sealing element even if the system is kept full at all times.

For the sealing element it may be possible to adjust operating parameters, such as, e.g., hydraulic or spring actuated radial force, during operation. Adjusting these adjustable operating parameters will affect leakage rate across the sealing element at a given set of operating parameters. In general, operating with a higher leakage rate will result in a lower wear rate.

In typical SBP (Surface Back Pressure) applications, the operating pressure below the sealing element is higher than (or equal to) the pressure above the sealing element. In a pumped riser solution as described in prior art, the pressure below the sealing element is lower than (or equal to) above the sealing element in normal operating conditions.

In the SBP system, it is typically a desire to avoid having significant leakage of drilling fluids across the sealing elements from below to above.

With a pumped riser in closed mode, it can for some operations be critical to ensure that there is zero or very low leakage across the sealing element but for other operations a significant leakage may be allowed, or even desired. However, in prior art there is no reliable method to achieve this variation in leakage rate. Moreover, there is no reliable method to verify that the desired leakage rate across the sealing element is achieved.

In the known systems the component with the lowest pressure rating will dictate the maximum size and intensity of an influx (kick) that the system can handle. This component is often the return pump. Increasing the pressure rating of the pump will have great implications on weight and size of the pump. In addition, there can be concerns about wear and what implications wear has on pressure integrity. For other components in the system, the wear rate is significantly less and more predictable and therefore typically not a concern from a pressure integrity perspective. Some pump systems may also have sealing functions between the process media and ambient sea that are acceptable for normal operations, but that may be considered an issue when circulating out a kick.

The pump type being used could be according to any pump principle such as centrifugal, positive displacement, eductor and so on.

Current Controlled Mud Level (CML) systems have mainly been operated in open mode.

CML systems are built with conventional auxiliary lines such as kill lines, choke lines and BOP hydraulic fluid lines, required hardware for CML and auxiliary lines needed to operate CML operations. The CML hardware is not built, or ready to be retrofitted, with the auxiliary lines, flow lines and other hardware that is needed to operate SBP On the other hand, an SBP system is built with conventional auxiliary lines such as kill lines, choke lines and BOP hydraulic fluid lines, in addition to the lines needed to operate the Surface Back Pressure system. Surface Back Pressure hardware is not built, or ready to be retrofitted, with the auxiliary lines other hardware that are needed to operate CML.

The operator must therefore choose which type of system to be used before manufacturing and installing the system. After the system has been installed, it is both expensive and time consuming to convert to another type of system as it will require extensive hardware modifications, or even having to procure new hardware components.

In conventional CML, a top-fill pump pumping drilling fluid into the top of the riser and/or drilling fluid pumped down the boost line to the top of the BOP is utilized to fill the riser. With a closed riser, the riser above the sealing element cannot be filled during operations from the boost line with a conventional set-up, as the entry point is located below the sealing element. Most rigs do not have a top-fill pump installed and the rig's trip tank pumps are typically not well suited for such a filling functionality in a controlled manner. Filling the riser above a closed sealing element is therefore not practicable with existing solutions.

Gas that comes up with the mud may accumulate below the closed sealing element. When the sealing element is opened or retrieved the accumulated gas would be released up the riser. The result is that gas flows out of the riser at the top and may spill out on the drill floor or cause an explosion hazard.

Some systems with sealing elements use two or more sealing elements in series spaced vertically along the riser and inject a barrier fluid between the seals at a pressure higher than the pressure below the lower sealing element. This ensures that no well fluids pass the sealing elements to flow into the riser above the sealing elements. In such a system it is possible to measure the leakage rate of barrier fluid into the system accurately. However, it may be impossible, or at least very difficult, to accurately measure how much liquid that goes upwards and how much liquid goes downwards at any given time.

Prior art riser systems have generally no means of detecting the position of a detected influx by measuring the density of the mixture of gas and mud and use this as a means for deciding when to isolate the pump and when to circulate out an influx using the closed riser system.

Sometimes a formation with a very narrow drilling window is encountered. A narrow drilling window means a formation where the difference between the minimum and maximum allowable pressure, typically given by the pore pressure and the fracturing pressure respectively, of the formation is very small. This means that only small pressure variations in the well are acceptable during operations. The existing topside choke on the rig is in many cases manual, or if automated, it does not have the ability to keep the pressure upstream the choke very accurate when the composition of the fluid flowing through the choke changes. Also, drilling contractors often have internal policies against using rig chokes for anything but well control events. For Surface Back Pressure operations today, an additional topside choke system is commonly used as a part of the Surface Back Pressure set up. Typically, the Surface Back Pressure choke is not the rig's well control choke, for fear of wearing it out. A significant piping network with separate flow paths involving, sensors, flow meters, valves piping etc. need to be constructed for typical Surface Back Pressure (SBP) operations.

On the one hand conventional pumped riser open mode CML systems are built with the infrastructure to support the needs of the CML functions including a dedicated umbilical. On the other hand, conventional Surface Back Pressure equipment is built with a dedicated umbilical to provide the required support functionality for that type of system. This covers electricity, hydraulics, sensor signals etc. CML systems and SBP systems have been seen as competing systems, where the driller choses one or the other. A combination of the two types of systems has not been described in prior art hitherto.

In line with the above, no prior art has suggested how to facilitate easy conversion of a system designed to perform CML to a system designed to perform SBP, or vice versa while using the same basic main building blocks. Prior art does also not describe a system that enables the driller to use a single hardware setup to perform both SBP and CML operations and that can switch seamlessly between the two methods in the matter of seconds or minutes.

In some cases, during well-construction, the encountered formation pressures are higher than what was anticipated when making the drilling plan. These higher than anticipated pressures may cause an influx and need to be dealt with before normal operations can continue. In order to deal with these pressures using conventional well-control methods, the pressure in the wellbore needs to be higher than the formation pressure. In prior art pumped riser systems, the maximum wellbore pressure that can be achieved without closing the Blow Out Preventer is limited by what is possible to achieve from the hydrostatic pressure of a riser column full of drilling mud.

In the present invention, several methods are shown that allow the driller to achieve a wellbore pressure that is higher than what could be achieved with prior art systems, which are doing this either by coupling the pumped riser system with a choke or by changing out the mud in the upper portion of the riser, above the riser sealing device, with a heavier mud, i.e. creating a column of heavier mud in the upper part of the riser. This column is sometimes called an "Upper Riser Cap".

Prior art closed loop systems are either for pumped riser systems where the system is used to reduce the wellbore pressure, or for back-pressure systems where a topside choke is used for adding wellbore pressure. In some situations, the desired wellbore pressure may be such that for a given mud weight and dynamic annular friction drop, pressure needs to be removed while circulating, but added when not circulating. A system able to seamlessly switch between removing and adding pressure in a controlled manner using a subsea pump and a topside choke in combination has not been described in prior art Based on prior art and techniques currently in use in Surface Back Pressure operations, it is either known, or obvious to the person skilled in the art, how an influx of hydrocarbons could be circulated out of the well using the riser sealing device, a return conduit and a topside choke. During such a process, a so-called well control event, it is important that the pressure in the wellbore is not too low, as it would allow further influxes of hydrocarbons, and not too high, as it would exceed the formation strength and fracture it. This lower limit is often referred to as the pore pressure and the upper limit as the formation fracture pressure, or in some cases just as the fracture pressure. In certain cases, the difference between the pore and fracture pressures is low, often referred to as a "narrow drilling window". During the process of circulating out the influx, where the objective is to keep the pressure in the wellbore between the maximum and the minimum limits, gas at high pressures is being circulated up the annulus. Due to the gas expansion effect with changing pressures, this means that the amount of additional pressure that needs to be applied during the well control event will typically increase throughout the process. A person skilled in the art is familiar with the above concepts.

When performing well-construction using a pumped riser system, the driller will typically choose a mud weight that is higher than what they would do during conventional drilling. Because of this, the pressure applied to the wellbore from a hydrostatic column to surface, would often be close to, or even above, the fracture pressure. During a well-control event, as the gas expands and takes up more space in the annulus, the weight of mud on the wellbore is reduced, with an associated wellbore pressure drop. In conventional well-control this is compensated for by increasing the back-pressure applied by the choke. The above means that for a well-control event with a pumped riser system, one might need to subtract pressure compared to that of a full riser at the start of the process, and then reduce the amount of subtracted pressure during the well-control circulation. Prior art does not describe how such a well-control event would be handled. The present invention describes how such an instance could be handled using the riser pump to reduce pressure, in some cases in combination with a choke either to apply additional pressure to compensate for the loss of hydrostatic associated with gas expansion. The choke used in combination with a subsea pump during well control could also be used to mitigate any slugging effects in the return line, as the choke could be used to ensure that the pressure in the return line is kept high enough to ensure a low Gas Void Fraction upstream the choke.

In some situations, without having taken a kick, the desired wellbore pressure may be such that for a given mud weight and dynamic annular friction drop, pressure needs to be removed while circulating, but added when not circulating. A system able to seamlessly switch between removing and adding pressure in a controlled manner using a subsea pump and a topside choke in combination has not been described in prior art Prior art does not describe how volume of liquid above the riser sealing element can be replaced and/or how the level can be altered during operations with a pumped riser system. This could be useful to do during operation for many reasons, such as to control the pressure above the riser sealing element, or to change out cuttings-laden mud with clean mud prior to periods of stand-still.

Prior art does also not describe how, for a pumped riser solution, it is possible to use liquid from above the riser sealing element to flush the return line with clean mud, or to maintain circulation in the return line without pumping down the drillstring or one of the auxiliary lines In prior art it is described how a pumped riser system can be operated without a dedicated return line using the riser as the return line, where the pump draws suction from below the riser sealing element and discharges above the riser sealing element, creating a differential pressure from above to below the riser sealing element. One of the key advantages cited for such a system is that it has less cost than other pumped riser systems as it does not require modifications to riser joints above the pumped riser components, and that there are no changes to the conventional mud return flow path topsides. For such a system, there are concerns about cuttings accumulating on top of the riser sealing element, and therefore prior art systems have described deflector and flushing systems to overcome this issue. Also, in such a system, the level in the riser is always full, and it is not possible to perform any operations with a reduced riser level.

20. A method of measuring changes in liquid volume in a well having a riser extending from a bottom of a body of water, the method comprising:

providing a riser having a return outlet to be coupled to a return pump, the return pump being adapted to pump fluid from the riser to above a surface of the body of water;

positioning a sealing element in the riser above the return outlet; providing a by-pass around the sealing element; operating in a closed mode where the sealing element and the by-pass are essentially closed to prevent flow therethrough;

preparing to switch to an open mode by opening the branch line extending from an outlet in the riser above the sealing element to a return line from the return pump, thereby allowing liquid to flow from the return line into the riser;

allowing the level of liquid in the return line to drop to a desired level;

stop the return pump; and determining changes in volume of liquid in the well based on measurement of volume in the return line.

21. The method of claim 20, comprising measuring a pressure in the riser below the sealing element and in the return line and monitoring a difference between the pressures to determine if the level in the return line has dropped to the desired level.

22. The method of claim 20, comprising the steps of:

determining if the level of liquid in the return line has dropped too far; and if the level has dropped too far, raising the level again by operating the return pump.

23. A method of measuring changes in liquid volume in a well having a riser extending from a bottom of a body of water, the method comprising:

providing a riser having a return outlet to be coupled to a return pump, the return pump being adapted to pump fluid from the riser to above a surface of the body of water;

positioning a sealing element in the riser above the return outlet;

providing a by-pass around the sealing element;

operating in a closed mode where the sealing element and the by-pass are essentially closed to prevent flow therethrough;

allowing liquid in an auxiliary line, extending from above the surface to an inlet on the riser below the sealing element, to flow into the riser;

allowing the level of liquid in the auxiliary line to drop to a desired level;

stop the return pump; and determining changes in volume of liquid in the well based on measurement of pressure in the auxiliary line.

24. The method of claim 23, comprising measuring a pressure in the riser below the sealing element and in the auxiliary line and monitoring a difference between the pressures to determine if the level in the auxiliary line has dropped to the desired level.

25. The method of claim 23, comprising the steps of:

determining if the level of liquid in the auxiliary line has dropped too far; and if the level has dropped too far, flowing drilling fluid into the auxiliary line.

26. A method of increasing a lifespan of a sealing element arranged in a riser extending from a bottom of a body of water, the method comprising:

monitoring a pressure in the riser below the sealing element;

monitoring a pressure or a level of liquid in the riser above the sealing element;

reducing the level of liquid above the sealing element to reduce a pressure difference across the sealing element;

providing a second outlet in the riser above the sealing element;

connecting the second outlet with the pump;

using the pump to drain fluid from the riser above the sealing element while the sealing element is closed;

monitoring the pressure difference to ensure the pressure above the sealing element is greater than the pressure below the sealing element; and increasing the level of liquid above the sealing element if the pressure difference sinks below a predetermined limit.

27. A method of determining a leakage rate across a sealing element arranged in a riser extending from a bottom of a body of water, the method comprising:

optionally, monitoring a pressure in the riser below the sealing element;

adjusting a level of liquid in the riser above the sealing element to below a slip-joint in the riser;

monitoring the level of liquid;

optionally, monitoring a pressure in the riser above the sealing element, the pressure being directly measured or calculated based on liquid level and density of liquid;

determining a change in level above the sealing element; and determining a leakage rate across the sealing element based on the change in level and known characteristics of the riser.

28. The method of claim 27, wherein the liquids level above the sealing element is adjusted by filling liquid into the riser from the top of the riser or into the riser at a level between the top of the riser and the sealing element through a fill line.

29. A method of increasing a lifespan of a sealing element arranged in a riser extending from a bottom of a body of water, the method comprising:

monitoring a pressure in the riser below the sealing element;

monitoring a pressure or a level of liquid in the riser above the sealing element;

monitoring a pressure difference across the sealing element to ensure the pressure above the sealing element is greater than the pressure below the sealing element; allowing leakage across the sealing element; and increasing the level of liquid above the sealing element if the pressure difference sinks below a predetermined limit.

30. A method of preventing leakage of hydrocarbons from below a sealing element to above the sealing element in a riser extending from a bottom of a body of water, the method comprising:

monitoring a pressure in the riser below the sealing element;

monitoring a pressure or a level of liquid in the riser above the sealing element;

monitoring a pressure difference to ensure the pressure above the sealing element is greater than the pressure below the sealing element; and increasing the level of liquid above the sealing element if the pressure difference sinks below a predetermined limit.

31. A method of monitoring and controlling a leakage across a sealing element in a riser, the riser extending from a bottom of a body of water, the method comprising:

monitoring a pressure in the riser below the sealing element;

monitoring a pressure or a level of liquid in the riser above the sealing element;

monitoring a pressure difference across the sealing element to ensure the pressure above the sealing element is greater than the pressure below the sealing element;

calculating a loss of liquid across the sealing element;

replacing the lost liquid by pumping liquid into the riser above the sealing element while measuring a flow of the liquid, and adjusting the flow of liquid to correspond to a rate of lost liquid.

32. The method according to claim 31, comprising adjusting a sealing force on the sealing element until a desired leakage rate across the sealing element has been met.

33. A method of determining volume changes in a well, extending from a bottom of a body of water, the method comprising:

providing a riser having a return outlet to be coupled to a return pump, the return pump being adapted to pump fluid through a return line from the riser to above a surface of the body of water;

positioning a sealing element in the riser above the return outlet;

establishing a branch line from above the sealing element to the return line;

stopping or ramping down circulation of drilling fluid into the well;

opening a by-pass around the sealing element;

draining drilling fluid from the return line into the riser above the sealing element; and monitoring a level of drilling fluid in the return line.

34. A method of circulating out an influx from a riser, wherein the riser has a sealing element and a return outlet below the sealing element, the method comprising:

providing at least two pressure sensors in the riser below the sealing element, the sensors being at substantially spaced apart locations;

using the pressure sensors to monitor a density of a drilling fluid in the riser;

based on changes of density of the drilling fluid, determining an approximate location of an influx in the riser; and selecting a flow route for the influx out of the riser based on a calculated amount of gas and location of the gas.

35. The method of claim 34, wherein a gas concentration above a predetermined value is circulated out of the riser in a by-pass around the return pump.

36. The method of claim 34, wherein a gas concentration below a predetermined volume is circulated out of the riser through the return pump.

37. A method of controlling a pressure in a well extending from a bottom of a body of water, the method comprising:

providing a riser having a return outlet to be coupled to a return pump, the return pump being adapted to pump fluid from the riser through a return line to a rig above a surface of the body of water;

providing an automatically adjustable choke between the return line and a drilling fluid treatment facility on the rig; and adjusting the automatically adjustable choke as a response to a monitored pressure in the well.

38. The method of claim 37, comprising adjusting a pumping rate of the return pump, in addition to adjusting the choke, as a response to a monitored pressure in the well.

39. A method of performing operations, in a well extending from a bottom of a body of water, the method comprising:

providing a riser having a return outlet to be coupled to a return pump, the return pump being adapted to pump fluid from the riser to above a surface of the body of water;

positioning a sealing element in the riser above the return outlet;

allowing a leakage across the sealing element;

monitoring a fluid level above the sealing element;

monitoring a pressure below the sealing element;

based on the fluid level calculating a pressure above the sealing element, comparing the pressures above and below the sealing element, and increasing a sealing force of the sealing element if a pressure differential across the sealing element exceeds a predetermined value, to prevent excess leakage from below to above the sealing element.

40. The method of claim 39, comprising the step of filling a liquid into the riser above the sealing element until the pressure above the sealing element is higher than the pressure below the sealing element.

41. A riser arrangement for performing operations, in a well extending from a bottom of a body of water, the arrangement comprising a riser, the riser being prepared for MPD operations with at least one specialized Managed Pressure Drilling riser joint, the joint having a bypass extending from a port below a position of a sealing element in the riser to a port above the sealing element, the bypass having a selectively controllable isolation valve, and being capable of operating in different operational modes, including:

pumped riser operations utilizing a subsea mud return pump at a location substantially below a surface of the body of water, the pump being coupled to the riser through a return outlet, and Surface Back Pressure operations with the specialized Managed Pressure Drilling joint located below a slip-joint close to the surface, wherein the arrangement comprising one or several modules containing electronics and hydraulics, where the modules can be mounted either to the subsea return pump or to the specialized Managed Pressure Drilling joint, the modules with electronics and hydraulics being configured so that they can be deployed to operate the arrangement either as a pumped riser system or as a Surface backpressure system, where both operational modes can be controlled using the same umbilical.

42. A method of handling gas accumulated below a sealing element in in a riser, the riser extending from a bottom of a body of water to above the surface of the water, the method comprising:

providing a return outlet in the riser below the sealing element, the return outlet being coupled to a return pump, the return pump being adapted to pump fluid from the riser to above a surface of the body of water;

providing a by-pass around the sealing element;

closing the by-pass;

filling the riser with drilling fluid above the sealing element; opening the by-pass and allowing the drilling mud to flow through the by-pass, out the outlet and through the pump at a rate high enough to flush gas in the riser through the pump and up to above the surface.

43. A method of monitoring a leakage rate across a sealing element in a riser extending from a bottom of a body of water, the method comprising: injecting a barrier fluid between an upper and a lower sealing element in the riser, injecting a drilling fluid above the upper sealing element, and keeping a level of the drilling fluid below any slip joint in the riser, monitoring the level of drilling fluid, and calculating a leakage rate across the upper sealing element based on a change in the level of drilling fluid.

44. The method of claim 43, comprising:

monitoring a pressure of barrier fluid between the upper and the lower sealing elements, maintaining the pressure of barrier fluid constant by refilling to replace any barrier fluid leakage, monitoring a volume of barrier fluid being pumped into the space between the upper and lower sealing elements, comparing the volume of barrier fluid with the leakage rate across the upper sealing element to determine a leakage rate across the lower sealing element.

45. A method of adjusting a level of fluid, replacing a fluid, or removing a fluid in an upper part of a riser, the riser extending from a bottom of a body of water to above the surface of the water, the method comprising:

providing the riser with a return outlet to be coupled to a return pump, the return pump being adapted to pump fluid from the riser to above a surface of the body of water, positioning a sealing element in the riser above the return outlet, providing a second outlet in the riser above the sealing element, connecting the second outlet with the pump, and using the pump to drain fluid from the riser above the sealing element while the sealing element is closed.

46. The method of claim 45, comprising: pumping fluid down a boost line, extending from above a surface of water, to a branch line, extending between the boost line and the riser above the sealing element.

47. The method of claim 45, comprising: filling the riser above the sealing element with a replacement fluid via the top of the riser or via a line coupled to a side of the riser.

48. The method of claim 45, comprising filling the riser above the sealing element with a replacement fluid via a line coupled to a side of the riser.

49. The method of claim 45, comprising filling the riser above the sealing element by opening the sealing element and allowing fluid to flow from below the sealing element to above the sealing element.

50. The method of claim 45, comprising filling the riser above the sealing element by opening a by-pass past the sealing element and allowing fluid to flow from below the sealing element to above the sealing element.

51. A method of preventing debris, to accumulate on to of a sealing element arranged in a riser, the method comprising:

installing an insert, the insert having a substantially smaller flow capacity than the riser above the sealing element to create a cavity in the riser between the sealing element and the insert, providing the riser with a return outlet to be coupled to a return pump, the return pump being adapted to pump fluid from below the sealing element to above the insert in the riser installing a branch line from an auxiliary line that allows liquid to be injected into the cavity, flowing drilling fluid into the cavity and upwards through the insert, at a rate which prevents debris from entering the cavity, pumping drilling mud with cuttings from below the sealing element to above the insert.

52. A method of preventing debris, to accumulate on to of a sealing element arranged in a riser, the method comprising:

installing a closure device in the riser above the sealing element to create a cavity in the riser between the sealing element and the closure device, providing the riser with a return outlet to be coupled to a return pump, the return pump being adapted to pump fluid from below the sealing element to above the insert in the riser, installing a branch line from an auxiliary line that allows liquid to be injected into the cavity, providing a by-pass around the closure device, flowing drilling fluid into the cavity and upwards through the by-pass, at a rate which prevents debris from entering the cavity.

53. A method of controlling a pressure in a drilling in a riser, comprising:

providing a sealing element in the riser, providing an auxiliary line extending from above a sea surface to an inlet at a lower part of the riser, providing an outlet from the riser at a point below the sealing element, coupling the outlet to a return pump, providing a return line coupling an outlet of the pump with a further inlet in the riser, the further inlet being arranged above the sealing element, providing a first branch line having at least one first isolation valve and coupling the outlet of the pump with the auxiliary line, flowing return drilling fluid from the riser outlet, through the pump and the return line.

54. The method of claim 53, wherein the return through the pump is routed to the inlet above the sealing element of the riser.

55. The method of claim 53, wherein the return through the pump via the first branch line to the auxiliary line.

56. The method of claim 53, comprising:

closing the isolation valve in the branch line, and using the auxiliary line as a boost line.

57. The method of claim 54, comprising:

providing a second branch line, having a at least one second isolation valve, between the auxiliary line and the riser above the sealing element, closing the first isolation valve, and flowing fluid through the auxiliary line and the branch line into the riser above the sealing element.

58. The method of claim 55, comprising: providing a third branch line between the auxiliary line and a drilling fluid treatment facility and flowing return drilling fluid via the third branch line to the drilling fluid treatment facility.

59. A method of operating a drilling system in open mode and closed mode, respectively, comprising:

providing a riser having a return outlet to be coupled to a return pump, the return pump being adapted to pump fluid from the riser to above a surface of the body of water, positioning a sealing element in the riser above the return outlet, providing a by-pass with a selectively controllable isolation valve around the sealing element switching between open and closed mode by either opening, respectively closing, the sealing element or opening, respectively closing, the bypass.

60. The method of claim 59, comprising:

arranging a choke downstream of the pump, returning drilling fluid from the pump through the choke when the drilling system is in closed mode, adjusting the choke and/or a pumping rate of the pump to regulate a pressure in the riser below the sealing element.

61. The method of claim 60, comprising:

arranging a bypass around the pump, isolating the pump from the bypass, flowing drilling fluid through the pump bypass, adjusting the choke to regulate a pressure in the riser below the sealing element.

62. The method of claim 60, wherein:

the operation of the pump and the choke enables alternation within seconds between an operating pressure below the sealing element that is lower than the equivalent pressure of a full mud column in the riser, and an operating pressure below the sealing element that is higher than the equivalent pressure of a full mud column in the riser.

63. A method of performing operations, in a well extending from a bottom of a body of water, the method comprising:

providing a riser having a return outlet to be coupled to a return pump, the return pump being adapted to pump fluid from the riser to above a surface of the body of water, positioning a sealing element in the riser above the return outlet, operating in a closed mode, where the sealing element and a by-pass extending around the sealing element are essentially closed to prevent flow therethrough, arranging a boost line coupled to the riser at an inlet below the sealing element, the boost line extending to above the surface of the body of water, stopping flow through a drill string extending through the riser when the system is in closed mode using the boost line as a pressure equalization line to take up U-tubing volume though a drill string extending through the riser.

64. An arrangement for building a riser joint for Managed Pressure Drilling operations where the riser joint has one configuration that can be used for Surface Back Pressure operations and one configuration that can be used for pumped riser operations with a sealing element installed, comprising:

an interface for installing the riser sealing element for both configurations, removable fixture on the joint for mounting a Surface Back Pressure hose end connection, removable fixture on the joint for mounting a Surface Back Pressure umbilical termination, an outlet port below and above the riser sealing element for mounting either a by-pass line for pumped riser operations or blind flanges for surface back pressure operations, and an outlet port below the riser sealing element for fluid communication with a subsea pump.

65. The arrangement of claim 64, comprising an inlet port above the riser sealing element, allowing filling of fluid in the riser above the sealing element.

66. The arrangement of claim 64, comprising a pressure sensor located above the riser sealing element, the pressure sensor providing pressure measurements used to calculate a fluid level in the riser.

67. The arrangement of any of claim 64, comprising an outlet port above the riser sealing element, the outlet port being coupled to a return pump, the return pump being adapted to pump fluid from the riser to above a surface of the body of water.

68. An arrangement for building a riser joint to be used in pumped riser operations comprising:

a riser sealing element;

a by-pass line having an isolation valve; and an outlet port above the riser sealing element, the outlet port being coupled to a return pump, the return pump being adapted to pump fluid from the riser to above a surface of the body of water.

69. The arrangement of claim 68, comprising a branch line extending from an auxiliary line above the riser sealing element that allows for filling liquid into the riser.

70. The arrangement of claim 68, comprising a pressure sensor above the riser sealing element.

71. A method of protecting against break-down of formation at a casing shoe, comprising:

positioning a sealing element in a riser;

providing a by-pass around the sealing element; and releasing in a controlled manner a pressure below the sealing element to above the sealing element by letting fluid flow through or past the sealing element.

72. The method of claim 71, comprising providing a riser having a return outlet to be coupled to a return pump, the return pump being adapted to pump fluid from the riser to above a surface of the body of water.

73. The method of claim 71, comprising:

providing a return outlet in the riser, the return outlet to be coupled to a return conduit to surface; and providing a surface choke to control the pressure below the sealing element 74. The method of claim 71, comprising monitoring a pressure in the riser below the sealing element.

75. The method of claim 71, comprising, operating with a reduced drilling fluid level above the sealing element.

76. A method of quantifying temperature-induced density changes of the mud in a well when downhole measurements are not available, comprising:

stopping pumping liquid from a surface into the well monitoring a level of drilling fluid in a riser extending from above a water surface and down to the well, determining level changes of drilling fluid in the riser, using known data on well geometry and well dimensions to calculate the volume of the well;

providing known data about drilling fluid density as a function of temperature and pressure;

using the known data about drilling fluid density and measured volume change in the riser to calculate temperature change and temperature-induced mud density reduction the well calculate a drop in downhole pressure caused by the temperature-induced drilling fluid density reduction using the above data to calculate a change in drilling fluid density in the well related to temperature increase of the drilling fluid for determining a pressure at any point in the well.

77. The method of claim 76, comprising using measurements or predictions of formation temperatures, calculate an expected temperature profile of the drilling fluid in the well along the wellbore, calculate an expected temperature volume change in the riser based on the expected temperature profile calculate a correction factor based on the expected temperature volume change in the riser and the measured volume change in the riser, and correct the expected temperature profile of the drilling fluid in the well along the wellbore for the correction factor to determine an induced temperature profile.

78. The method of claim 76, comprising using the induced temperature profile and the known data about drilling fluid density as a function of temperature and pressure to calculate a wellbore pressure profile.

79. The method of claim 76, comprising comparing the wellbore pressure profile with a desired pressure profile to calculate a required change of riser level to compensate for the difference between the wellbore pressure profile and the desired pressure profile.

80. The method of claim 76, for adjusting the riser level to correct for calculated pressure deviations in the well, comprising:

providing a riser having a return outlet to be coupled to a return pump, the return pump being adapted to pump fluid from the riser to above a surface of the body of water, filling the riser without pumping through the drillstring, and adjusting the level of mud in the riser to a desired level.

Prior art also describes using one of the auxiliary lines as a return conduit, either for the entire well-operation, effectively rendering the return conduit incapable of performing its initially intended purpose for the entire operation, or as a contingency, for instance if handling an influx and circulating up the auxiliary line, potentially coupled to a topside choke, whilst handling the influx event.

In prior art pumped riser systems without a dedicated return line, the riser needs to remain full at all times as there is no way of lowering the riser level. If the system is then operated in open mode, the full riser pressure is applied on the well.

Another method for reducing the cost of rig integration described in prior art is to use an existing auxiliary line, such as the boost line, as a return line. When performing such modifications in prior art, the original functionality of the existing auxiliary line has not been available when performing closed riser operations.

Some prior art examples are shown in:

US 2003/066650 describes a drilling system for drilling subsea wellbores includes a tubing-conveyed drill bit that passes through a subsea wellhead. Surface supplied drilling fluid flows through the tubing, discharges at the drill bit, returns to the wellhead through a wellbore annulus, and flows to the surface via a riser extending from the wellhead. A flow restriction device positioned in the riser restricts the flow of the returning fluid while an active fluid device controllably discharges fluid from a location below to just above the flow restriction device in the riser, thereby controlling bottomhole pressure and equivalent circulating density ("ECD"). Alternatively, the fluid is discharged into a separate return line thereby providing dual gradient drilling while controlling bottomhole pressure and ECD. A controller controls the energy and thus the speed of the pump in response to downhole measurement(s) to maintain the ECD at a predetermined value or within a predetermined range. This solution is only capable of performing closed riser operations.

WO 2013/055226 describes a device and method for control of return flow from a borehole where drill fluid is supplied from a surface rig via a multi section drill string to a bottom hole assembly, the drill pipe sections having tool joints that include an enlarged outer diameter portion, and where an annulus is formed between a pipe and the drill string, and where the annulus is in fluid communication with or forms part of a return path for the drill fluid, and where a choke is positioned in the annulus, and where the length of the choke exceeds the distance between the enlarged outer diameter portion of two adjacent tool joints. This solution is also only capable of performing closed riser operations.

WO 2017/195175 describes a subsea drilling method for controlling the bottom hole annular pressure and downward injection rate during mud cap drilling operations from a mobile offshore drilling unit with a low-pressure marine riser and subsea blowout preventer. The method called controlled mud cap drilling uses the hydrostatic head of a heavy annular mud (fluid) managed or observed in order to balance the highest pore pressure in the well and to control the injection rate, by using a subsea mud lift pump and a control system to regulate the process. In this system, a riser sealing device could also be included. The intention of the riser sealing device is to create a riser void that can be used for various reasons but not to create a closed riser system to control downhole pressures.

GB 2502626 describes a system for controlling the fluid pressure of a borehole during drilling of the borehole. A drill pipe is arranged in the borehole, the pipe is configured to provide drilling fluid in the borehole. Sealing means are provided and arranged to seal about an outer surface of the drill pipe to separate the drilling fluid in the borehole on a first side of the sealing means from a fluid on a second side of the sealing means. Furthermore, a subsea pump arrangement is arranged to receive a flow of the drilling fluid from the borehole. The pump arrangement operates to pump drilling fluid out of the pump arrangement and generate a fluid pressure in the drilling fluid at a location upstream of the pump arrangement. The generated pressure is less than or equal to the hydrostatic pressure of the fluid on the second side of the sealing means. This system is only capable of operating in closed mode.

WO 2016/135480 describes a riser assembly comprising a main body enclosing a main passage which extends from a first end of the main body to a second end of the main body generally parallel to a longitudinal axis of the main body, the main body being suitable for mounting in a riser so that main passage forms a part of a main passage of the riser, the riser assembly further including a sealing assembly which is operable to provide a seal between the main body and a tubular extending along the main passage of the main body so as to substantially prevent flow of fluid of fluid along the main passage around the tubular, and two or more diversion lines each of which extends from a first port in the main body to a second port in the main body, the ports extending through the main body to connect the main passage with the exterior of the main body, the sealing assembly being located in the main body between the first and second ports, wherein a pump is located within each diversion line, the pump being operable to pump fluid along the diversion line in which it is located.

SUMMARY OF INVENTION

In a first aspect of the present invention it aims to facilitate all aspects of drilling operations, in a pumped riser closed mode with pressure control below a sealing element, and a pumped riser open mode with a reduced level, without having to remove the sealing element. The sealing element may be a Rotary Sealing Device (RSD) or an annular seal intended for non-rotation only This is achieved by adding a by-pass arrangement to the riser to be able to bypass fluid around the sealing element, a mud return line and operating with a riser level below the depth of the slip-joint at the upper end of the riser, also when operating in closed mode. It is thereby possible to switch seamlessly between a closed mode and an open mode and vice versa by opening and closing the valve on the by-pass arrangement. A level sensor located above the sealing element, such as a pressure sensor from which the level can be calculated, is a key to operating this system.

The bypass functionality may also be achieved by opening up the sealing element to allow flow through it, if the sealing element design allows this.

In a second aspect of the invention a system is created that operates in closed mode but that can be converted to open mode in order to use the riser to more accurately measure volume changes of mud in the system.

By adding a by-pass arrangement around the sealing element, a mud return line and operating with a riser level below the slip-joint (if required) level when the system is set to operate in in closed mode it is possible to switch seamlessly from closed mode to open mode, or vice versa, by opening the bypass valves to open a flow path between below the sealing element and above the sealing element. This may be done with a pressure above the riser sealing element that is predominantly higher than, equal to or lower than the operating pressure below the sealing element. The riser volume measurement associated with open mode can then be used also when operating with a sealing element installed. This will be of particular interest in static conditions as the riser can be isolated and the riser can be used as a tank, where the volume measurement is unaffected by rig motion, to get improved volume accuracy compared to other methods. The by-pass arrangement coupled with the pressure measurement below the sealing element can also be used as a release mechanism to avoid over-pressurizing the system below the sealing element in case of a system malfunction, mud return line blockage or similar.

The bypass functionality may also be achieved by opening up the sealing element to allow flow through it, when the sealing element design so allows.

In a third aspect of the invention, using the same hardware arrangement as described in the second aspect, the riser level is set, or adjusted to, a desired level and the by-pass is opened to allow for operation in open mode in a contingency scenario such as e.g. stuck pipe. Such situations may involve firing a downhole drilling jar installed in the drilling string or working the drilling string violently. Such activities could damage the sealing element. By using the present invention, the sealing element can be moved to a more relaxed state which would have less damage potential, whilst maintaining the desired pressure in the well. Subsequent to opening the by-pass and relaxing the sealing element, the level in the riser may be further changed to adjust wellbore pressures to assist in remedying the situation. With the presence of the sealing element, that can be rapidly closed, it may be permissible to reduce the downhole pressure further than what would have been permissible without the sealing element in place.

In a fourth aspect of the invention, using the same hardware as described in the second and third aspect, the system is operated in open mode but can quickly be converted to closed mode by simply closing the by-pass. This would be of particular interest in sections of the well where there is identified some form of risk which would be mitigated by a closed system, but where there is of interest to utilize one of the benefits of the open system. Examples that can be mentioned include to reduce drill pipe connection time by not having to move the riser level when compensating for loss of annular friction due to pumping, or if it is desired to use the volume accuracy of the open system when pulling out of hole when drilling a High Pressure, High Temperature (HPHT) well to measure the volume expansion effect of the fluid in the well as the stagnant fluid in the well heats up, calculate the associated fluid density drop, estimate the pressure drop in the wellbore associated with the reduction in density and use the ability to raise the level in the riser in a controlled manner to raise the level to compensate for the drop in wellbore pressure.

In a fifth aspect of the invention the lifespan of a sealing element can be prolonged. According to the invention, this is achieved by reducing the riser level above the sealing element, and thus also the pressure above the sealing element. The differential pressure across the sealing element can thereby be reduced and hence the lifespan of the sealing element be prolonged.

In a sixth aspect of the invention, the aim is to determine the leakage rate across the sealing element. This is done according to the invention by providing a level or pressure sensor, to monitor the change in riser level above the sealing element. The leakage rate can then be calculated based on the geometry of riser and pipe between the sealing element and a liquid/gas interface. By operating with a riser level below the slip joint, uncertainties associated with rig movement and slip-joint movement are removed. These measurements may be operated in conjunction with some form of top-fill pump, or a subsea tie-in from a line such as boost line, choke line, or kill line together with some method of measuring flow in, e.g., a flow-meter to monitor the total volume in the riser above the slip joint and thus the loss or gain rate.

In a seventh aspect of the invention the invention provides operation with a significant leakage rate across the sealing element from above to below with the objective to reduce the wear on the sealing element.

As long as it is possible to verify that there is leakage from above to below the sealing element, and it is possible to achieve the desired operating pressure below the sealing element, it can be determined that the sealing element is fulfilling its main functionality.

This means that, based on the criticality of the ongoing operations, it may be decided that in parts of the well it is acceptable to operate with a significant leakage rate across the sealing element, as long as it can be verified that the leakage is from above to below the sealing element.

In an eighth aspect of the invention, The mud level in the riser above the sealing element is monitored by a level/pressure sensor and leakage across the sealing element is compensated for by using a pump and a flow meter, or other alternative method to measure inflow, to fill the riser in order to maintain a close to constant riser level.

The constant level in the riser is conveniently controlled by an automated controller with an algorithm that monitors the riser level and operate the pump filling to maintain the riser level within predetermined parameters.

In operational modes where the pressure below the sealing elements are higher than above, the leakage will be from below to above and the measured riser level will increase. In such situations, the level will not be kept constant, but may need to be reduced in steps at given intervals, using the subsea pump.

In a ninth aspect of the invention the operating parameters of the sealing element can be adjusted in a controlled manner to switch between allowed, or intended, leakage across the sealing element to zero or minimal leakage. This can be done by a controller with an algorithm in an automated manner. The automated system adjusts the closing pressure/force on the sealing element to control the leakage rate using riser pressure sensor(s)/level sensor(s) above the sealing element, in combination with readings from any other flow into the riser above the sealing element, in a method for determining the flow across the sealing element.

In a tenth aspect of the invention a pressure rating of the return pump, that is lower than the rest of the system components, is circumvented by a valving arrangement that allows for normal operations using the pump, but provides for a bypass of the pump for handling of influxes, so that a gas influx can be circulated up the riser through an outlet below the sealing element and up the return line. This increases the operating envelope when circulating out the influx (kick).

In an eleventh aspect of the invention it provides for easy retrofitting to convert an SBP system to be able to operate as a CML system, or vice versa. The system is upon installation either fitted with the lines needed or built with the required mounting space for additional hardware and with cut-outs and other features on the maximum OD to allow for CML lines (typically 4 to 6") to be retrofitted.

In a twelfth aspect of the invention, the boost line is used as a pressure equalization line to mitigate the u-tubing effect in the drill pipe when not circulating when operating without a u-tube arrestor valve. This aspect of the invention also enables improved measurements of Shut In Drill Pipe Pressure when taking a low intensity kick.

In a thirteenth aspect of the invention it aims at avoiding gas flowing up to the top of the riser when opening or retrieving the sealing elements. This is achieved by filling the riser from the top, opening the by-pass and operate the pump to generate a substantial flow from above, through the by-pass around the sealing element and down through the pump and up the return line. By flowing at high rates, this can be used to flush the gas through the return pump and up the return line, where it can be routed to a safe location on surface, such as a mud/gas separator.

In a fourteenth aspect, the invention provides an alternative to the second aspect of the invention. When operating the system in closed mode, i.e. with a sealing element in the riser, it may be is desirable to switch to the open mode to perform static volume checks by opening the above-mentioned by-pass, or alternatively by allowing communication between above and below the sealing element through the element. In this situation, if the pressure above the sealing element is significantly different than what is desired to have below the sealing element when the rig pumps are turned off (i.e. when the suction pressure of the pump is increased to compensate for the loss of dynamic friction losses in the well), there is a need to adjust the riser level. This will take time, which to the operator means increased cost.

The alternative to the above is, when switching from closed to open mode, to use the return line from the return pump as an in-line trip tank. By providing a branch line from the riser above the sealing element to the return line, this line can be opened, either as the rig pumps are ramped down, or after the pumps have been ramped down. Then the return line can be drained to the pre-determined level by letting mud flow from the return line into the riser above the sealing element. Alternatively, the by-pass around the sealing element can be opened, or the annular sealing element relaxed, so as to allow flow from below to above sealing element. With a centrifugal pump this could be achieved without opening the bypass round the pump, with a positive displacement pump the by-pass would have to be opened. Once the level has dropped to, or below the desired level, the flow paths that were opened to allow the level drop are closed. Pressure sensors in the return line or the riser can be used to determine the level of mud in the return line. As an alternative to using the pressure sensors in the return line to determine the level, the level can be allowed to drop to equalize the level in the riser and then the pump with associated flow measurements or calculations can be used to regulate the MRL level to the desired level. A person skilled in the art of pump control could find many different ways of achieving this depending on the pump type being used.

This method will be of particular usefulness in a situation where we are operating with a small pressure differential across the sealing element in dynamic conditions, i.e. flowing through the drill string, and closing the sealing element to allow zero flow across when the pumps are turned off (and the pressure below the sealing element is higher than above). In such a situation, the level in the riser would need to be increased significantly in order to maintain the correct downhole pressure with zero flow down the drill pipe.

In the system of the invention, when operating in closed mode, it is possible to have a higher pressure below the sealing element than that which could be achieved in an open mode with a riser full of drilling fluid. The most likely scenario for when this happens is if there is an influx of gas that moves up the riser and the operator is compensating for this in order to keep the wellbore pressure within the acceptable pressure envelope. In this situation, there must be a zero, or very low, leakage rate across the sealing element to avoid hydrocarbons, especially gas, to enter the riser above the sealing element, as it can cause uncontrolled flow to the platform deck and/or risk of ignition on the platform.

As the return line has a smaller diameter than the riser, any volume changes in the well will cause a larger change in the return line level than it would have done in the riser. This means that an even more accurate reading of volume changes can be made using this method than when using the riser as a tank. Since the level changes more rapidly than when using the riser, for a given volume change in the well, this means that the pressure exerted on the well in case of an influx, will increase rapidly, as the level in the return line increases. Since the diameter of the well in most cases, except when drilling very slim holes, will be larger than the diameter of the mud return line, the system will have a self-regulating effect towards stopping an influx.

As an alternative to using the return line for this purpose, the boost line can be fitted with a pressure sensor or level sensor, and the level can be adjusted in a manner similar to that described above to use the boost line as an in-line trip-tank when operating with a closed system.

In a fifteenth aspect of the invention, it prescribes a method to measure the leaking rate of a barrier fluid that is injected between two sealing elements, upwards and downwards, respectively. This is achieved by having a level of mud below the slip joint above the upper sealing element and monitoring this level by a level sensor or a pressure sensor. This gives a measure of how much barrier fluid has leaked upwards. When this upwards leakage volume is compared with the total consumption of barrier fluid, also a value of downward leakage volume can be calculated.

In a sixteenth aspect of the invention, it provides a method for determining how best to handle an influx and how best to circulate it out of the riser.

The invention provides for circulating the influx out through one of two different outlets from the riser, either through the return pump or through a by-pass around the return pump. In order to determine when to switch from pumping through the pump to using the by-pass, the location of the gas/liquid mixture in the riser is calculated. To this end pressure measurements over time in the riser, such as by a pressure sensor below the sealing element and a pressure sensor on the BOP (Blow Out Preventer), which are substantially spaced apart, are used to determine the average density and the variation thereof over time. By combining this with known gas pressure vs. density models and the mud weight, the approximate location of the gas, as it propagates up the riser, can be determined.

If the amount of gas is relatively low, it can be circulated out through the return pump as it reaches the outlet to the pump. If the amount of gas is relatively high, it is better to isolate the pump and let the gas flow out through the by-pass around the return pump. In such a scenario, the topside choke(s) may or may not be used at the same time.

In a seventeenth aspect of the invention the problem of regulating the pressure in the well accurately when drilling in formations with a narrow drilling window, is solved by introducing an automated choke with a high-quality hydraulic model controller upstream the existing rig choke and to use the mud return line as a low-pressure choke line for influxes that are handled through the riser. By this a very precise control of well pressure during circulation of a kick can be achieved, while avoiding having to install a significant amount of additional pipework and valves. The flow will still go through the rig's drilling choke, but this may be left in a fully open position, or it may be used to choke part of the pressure. In such a set-up it is possible to route the return line directly into the rig's existing choke manifold and save substantial cost. Such a set-up will typically not be acceptable for a conventional SBP type operation as the choke needs to be operated at all times for an SBP operation, and there will be concerns about wearing out the rig choke, even if left in an open position, and not having it fully functional when it is needed. For a pumped riser solution, on the other hand, the choke will only be operated very infrequently and for a limited time, and therefore it may be found such a set-up is acceptable from a risk perspective. Alternatively, the rig choke may be bypassed, and the flow routed directly to the mud gas separator.

In an eighteenth aspect of the invention it provides a novel combination of a system designed to perform CML operations and a system designed to perform SBP operations. However, at the outset, a system combining the full functionality of the two systems will be very costly to build. Surface Back Pressure riser-mounted equipment is typically placed at surface or less than 100 m below the water line. Pumped riser equipment is typically placed much deeper, typically 200-400 m below the water line. If using a sealing element and/or annular from a system that was originally designed as Surface Back Pressure equipment, the existing umbilical for this system should be made longer to allow for a deeper placement of the system in the combined system. This would not only mean a longer umbilical but would also require a larger drum that could hold more umbilical. That would, however, mean that there would be separate umbilicals for the sealing element and the return pump. It is desirable to have as few umbilicals in the moonpool as possible.

The challenge in combining the two systems with their different infrastructure has been overcome by taking a pump module that is used in pumped riser operations without the sealing element functionality, and adding a hardware module that is mounted to, or one or several modules that may not necessarily be mounted to the pump, containing not only the required additional valving, hydraulics and sensors required, but also the required electronics and hydraulic functionality to operate and monitor the sealing element and annular. When the annular and/or the sealing element is to be used in a pumped riser application, this additional electronics and hydraulics functionality of the present invention is connected to the annular/sealing element joint instead of the umbilical that is used when operated in SBP operations. In this way, a more-cost effective and versatile system can be built. In this system, some components for the complete system will also be mounted on the existing RSD/annular joint. Jumpers will be mounted between the additional module and the riser joint with the RSD. This additional equipment mounted within the added hardware module(s) will use the same umbilical to topside for signals, power, hydraulic supply and so on as the one being used to drive and control the pump. This umbilical will conveniently be of the same design as the one being used when operating solely in pumped riser open mode (CML).

In a nineteenth aspect of the invention, it provides for retrofit of a riser joint designed to perform SBP operations so that the same joint can be used for CML operations. This is achieved by including features required for CML, such as an outlet for a mud return line, mounting areas for additional components such as sensors, outlets for a by-pass line and pressure sensor on the riser body so that the component that is originally intended for SBP can later be retrofitted to be used in Pumped Riser operations.

The hardware can be modularized, so that components from CML and SBP are mixed and can be run together as a single system.

In a twentieth aspect of the invention, it is possible, with the riser sealing device in place, to draw suction to the pump from above the riser sealing device, in order to reduce the level in the riser above the sealing device to maintain flow in the pump return line with no flow out from below the riser sealing device, to change out the liquid in the riser with a lighter or heavier fluid, to remove mud with hydrocarbons through the pump system or for any other reason where it may be desirable to alter the level of fluid or change the fluid itself in the riser above the riser sealing device. This is achieved by having a riser outlet above the riser sealing device connected to the pump suction. This outlet is fitted with an isolation valve. The mud above the sealing element may be changed out either by allowing flow up the riser with the riser sealing element open, or by filling the riser above the riser sealing element and drawing suction through the pump.

In a twenty-first aspect of the invention, a specific method for ensuring that cuttings are not allowed to accumulate on top of the riser sealing element is described. This is particularly relevant for operations where the riser above the riser sealing element is used for taking returns during drilling with the riser sealing element closed and the return mud will be laden with cuttings. This method of ensuring that no cuttings accumulate on top of the riser sealing element is achieved by pumping down the boost-line, or any other auxiliary line, which is connected to the riser above the riser closure device with isolation valves, in combination with an insert in the riser above the riser closure device. The insert is such that there is only a small part of the cross-sectional area that is open to flow. Typically, that would be a radial clearance between the drill-pipe and the insert, but there are also other configurations where there are clearances elsewhere in the insert. Alternatively, the insert could be a riser closure device that fully seals the annulus, in combination with a by-pass arrangement. In this aspect of the invention, liquid is pumped into the cavity between the riser sealing element and the riser insert. Since the riser sealing element does not allow, or only allows very limited, flow from above to below, this injected liquid will flow upwards, through the riser insert clearances with an upward flow velocity that ensures that cuttings from above are not allowed to fall down into the cavity between the riser closure device and the insert.

In a twenty-second aspect of the invention, a method is described for removing cuttings that for any reason may have entered the cavity described in the section above. This is achieved by opening the riser closure device, or a by-pass to the riser closure device and pumping into the cavity from the auxiliary line with clean drilling mud, or any other clean liquid, at the same time as the riser pump is operated in order to create a downwards flow that will remove the accumulated cuttings. In situations where opening the riser closure device with a full riser could exceed the maximum pressure the well can withstand, this opening of the riser closure device could be preceded by lowering the level in the riser above the riser closure device using any of the methods described herein.

In a twenty-third aspect of the invention, a method is described that allows for operations utilizing an auxiliary line for three different purposes. It is used as a mud return line in certain instances, whilst still maintaining the original functionality of the auxiliary line for all other instances. In this aspect of the invention, the primary mode of operation during drilling and well construction is to operate with the riser closure device in place, using the pump to pump from below to above the riser closure device and taking returns up the riser. In this aspect of the invention, the pump discharge is also connected to an auxiliary line, typically the boost line, with an isolation valve arrangement that allows the driller to choose whether the discharge should be routed to the riser, or to the auxiliary line. This gives the driller the ability of being able to regulate the riser level and maintain the ability to perform all the originally intended functions of the auxiliary lines without having to modify existing riser joints above the pumped riser components. The riser level regulation and the use of the originally intended function of the auxiliary line cannot happen at the same time, but the driller may alternate between the two options in this aspect of the invention. In addition, the auxiliary line, if the boost line is used, can be used simultaneously as a boost line and as the injection line in aspect twenty-one.

Prior art descriptions of the pumped riser have been primarily focused on pressure control of the wellbore during the drilling process only. There are, however, a number of other aspects of the well-construction process where pressure control of the wellbore is equally important. The challenge is that existing riser closure devices may not be able to seal on well equipment of changing diameters such as what is encountered when running casing, for cementing operations or when running completions. In some cases when operating with a riser closure device in place, it may be possible to close the Blow Out Preventer to maintain wellbore pressure while running equipment of varying diameter into the well above the BOP, but the person skilled in the art will know that it is difficult to maintain active pressure control in all situations when operating such equipment.

Being able to regulate the liquid level in the riser and operating the system without the riser closure device active would in many instances overcome this challenge.

In this aspect of the invention, some modification will typically also be required for the topside piping of the auxiliary line to allow returns to be routed to the mud treatment system.

In a twenty-fourth aspect of the invention, the system is alternated between open and closed mode, and is operated in a manner such that the pressure above the riser sealing element is predominantly lower than, or equal to, the operating pressure below the sealing element when operating in a closed mode. An example would be where the system is operated in open mode when circulating down the drill-string and in a closed mode when not circulating down the drill-string, using the ability of the closed system to quickly alter the pump suction pressure to compensate for the loss of wellbore friction losses caused by stopping the mud pumps during a connection. The switch between open mode and closed mode can be done in seconds by closing the by-pass around the RSD, or by closing the RSD itself. This aspect of the invention is relevant where the Controlled Mud Level benefits of an open system are desired, such as using an over-balanced mud, being able to move tubulars of varying diameters in and out of the hole whilst regulating wellbore pressure, or to use the accuracy of the riser pressure measurements to accurately measure the volume of drilling fluid in the well, but where the closed mode benefits are desired in some instances of the operation. Examples could be the ability to compensate for loss of wellbore friction during connections as described above, to quickly add pressure to suppress an influx, or to circulate out an influx without closing the BOP.

In a twenty-fifth aspect of the invention, the system also incorporates a choke downstream the pump that is used for wellbore pressure regulation when the system is operated in closed mode. With this setup, a system with a unique ability not described in prior art to seamlessly switch between operations that both add and remove pressure compared to that of a full riser is introduced. In this aspect of the invention, the choke may be operated without using the pump to add pressure beyond what can be achieved with a full riser, the pump may be operated without using the choke to reduce the pressure to below that of a full riser, or the choke can be used in series with the pump at certain intervals during the well-construction process to achieve a pressure higher than, lower than or equal to that of a full riser. Examples of when this aspect of the invention would be applicable, is when the system is being operated with a mud-weight that is such that the well pressure is above fracture pressure with a full riser when adding the frictional losses caused by drilling fluid circulation during drilling, but in under-balance, i.e. below the pore pressure when the circulation of drilling fluid is stopped, even if the drilling fluid level is increased to a full riser. Alternatively, for well-control scenarios where the choke is an integral part of the procedures, but where the required pressures just after taking the kick are such that the pump is needed to remove pressure. In this aspect of the invention, the driller is able to both add and remove pressure, compared to that of a full riser. Such an operational mode could also be used to add back-pressure to the return line in order to avoid slugging or mitigate negative effects of foaming for certain operational modes where this could be relevant. The present invention describes how such an instance could be handled using the riser pump to reduce pressure, in some cases in combination with a choke either to apply additional pressure to compensate for the loss of hydrostatic associated with gas expansion. The choke used in combination with a subsea pump during well control could also be used to mitigate any slugging effects in the return line, as the choke could be used to ensure that the pressure in the return line is kept high enough to ensure a low Gas Void Fraction upstream the choke.

When performing well-construction using a pumped riser system, the driller will typically choose a mud weight that is higher than what they would do during conventional drilling. Because of this, the pressure applied to the wellbore from a hydrostatic column to surface, would often be close to, or even above, the fracture pressure. During a well-control event, as the gas expands and takes up more space in the annulus, the weight of mud on the wellbore is reduced, with an associated wellbore pressure drop. In conventional well-control this is compensated for by increasing the back-pressure applied by the choke. The above means that for a well-control event with a pumped riser system, one might need to subtract pressure compared to that of a full riser at the start of the process, and then reduce the amount of subtracted pressure during the well-control circulation. Prior art does not describe how such a well-control event would be handled. The present invention describes how such an instance could be handled using the riser pump to reduce pressure, in some cases in combination with a choke either to apply additional pressure to compensate for the loss of hydrostatic associated with gas expansion. The choke used in combination with a subsea pump during well control could also be used to mitigate any slugging effects in the return line, as the choke could be used to ensure that the pressure in the return line is kept high enough to ensure a low Gas Void Fraction upstream the choke.

In some situations, without having taken a kick, the desired wellbore pressure may be such that for a given mud weight and dynamic annular friction drop, pressure needs to be removed while circulating, but added when not circulating. A system able to seamlessly switch between removing and adding pressure in a controlled manner using a subsea pump and a topside choke in combination has not been described in prior art In a twenty-sixth aspect of the invention, the system is operated with a reduced riser level and the volume accuracy of the system is used to measure volume changes that together with information on the well geometry and known properties of the mud is used to calculate changes in downhole mud temperatures and associated volume and density effects while not having the bottom-hole assembly at the bottom of the well. The system can then also be used to compensate for the drop in downhole pressures by increasing the riser level to compensate for the loss of density associated with the temperature increase.

Prior art does not describe how volume of liquid above the riser sealing element can be replaced and/or how the level can be altered during operations with a pumped riser system. This could be useful to do during operation for many reasons, such as to control the pressure above the riser sealing element, or to change out cuttings-laden mud with clean mud prior to periods of stand-still.

Prior art does also not describe how, for a pumped riser solution, it is possible to use liquid from above the riser sealing element to flush the return line with clean mud, or to maintain circulation in the return line without pumping down the drillstring or one of the auxiliary lines

DETAILED DESCRIPTION OF PRIOR ART SYSTEMS

Some examples of prior art systems that the present invention departs from, will now be explained in order to better understand the subsequent description of the present invention.

Figure 1:
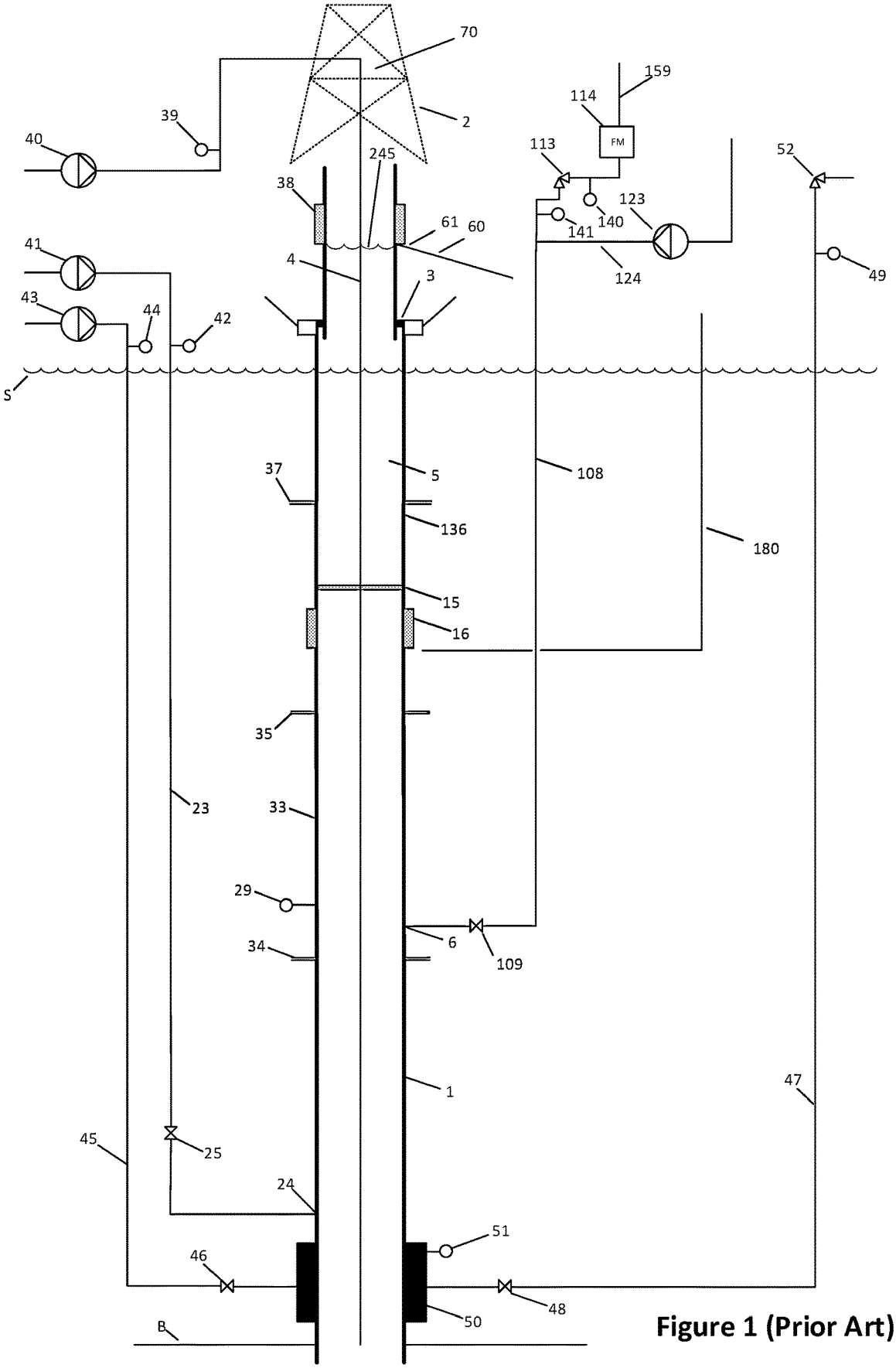
Figure 1 (Prior Art)
FIG. 1 shows schematically a prior art system of the so-called Surface Back Pressure (SBP) type.

FIG. 1 shows a system according to the so-called Surface Back Pressure (SBP) type. In this system the principle is to close the riser to make the pressure in the riser independent of the surface pressure at the top of the riser. In this system a pressure in the well higher than the pressure of a liquid column from the surface can be achieved.

For such a system, it could be necessary to use a so-called underbalanced fluid when drilling wells. Particularly if the drilling window is narrow. A drilling fluid is called underbalanced when the pressure in the well with a riser full of drilling fluid is lower than the pore pressure of the formation being drilled. The drilling fluid can be a liquid or a mixture of liquid or gas, such as a foam, depending on the specific gravity needed for the fluid.

FIG. 1 shows a drilling riser 1 extending from a drilling platform or vessel 2 at a surface S of a body of water to a bottom B of the body of water. The drilling riser 1 contains a slip joint 3 that is adapted to take up relative movement between the drilling platform or vessel 2 and the riser 1.

A drill string 4 extends along the inside of the drilling riser 1 and into the well (not shown). An annulus 5 is formed between the drill string 4 and the riser 1.

A drilling fluid, also called mud, is pumped down the drill string 4, out the lower end of the drill string 4 and up the annulus 5. After the mud has exited from the lower end of the drill string 4, it will become mixed with the content of the well, such as oil, gas, water, particles, rocks etc. and flow up the annulus 5. The mud is pumped down the drill string 4 by a rig pump (usually a set of pumps) 40. A pressure sensor 39 is conveniently arranged at the outlet of the rig pump 40, typically on the stand-pipe 70 which is located on, or close to, the drill-floor.

One or more pressure sensors 29 could be arranged in the riser. However, in practice the sensors are arranged topside. There is also a pressure sensor 51 on the BOP.

A choke line 47 extends from a BOP 50. The choke line 47 has an isolation valve 48 and a pressure sensor 49. The choke line 47 is coupled to a rig choke 52.

A kill line 45 is coupled to the BOP 50 via an isolation valve 46. At the upper end of the kill line 45 is a liquid pump 43 and a pressure sensor 44.

A boost line 23 is coupled between an inlet 24 that is arranged close to the BOP 50. The line 23 has isolation valve 25 and is supplied by a boost pump 41. A pressure sensor 42 is included in the line 23.

At a depth below the surface there is an outlet 6 from the riser 1. The outlet is coupled to a flow line 108 with an isolation valve 109. The flow line 108 extends to the platform 2, where the line 108 is coupled via a choke 113 and a flow meter 114 to a mud treatment facility (not shown) through line 159. The choke 113 has mounted an upstream pressure sensor 141 and a downstream pressure sensor 140 thereto. A branch line 124 is coupled to a boost pump 123. The line 124, 108 with a valve (such as valve 109) may alternatively be duplicated as a second line from a second outlet, located close to the riser outlet 6. This duplication is to ensure there is an available flow-path to surface in case of any malfunction in the line 108.

At the top of the riser 1 there is an annular sealing element or diverter 38. The annular sealing element 38 is used to close the riser annulus 5 if gas should rise to the top of the riser 1. Below the diverter 38, is located an outlet 61 commonly known as a bell-nipple. This is connected to a flowline 60 that allows the drilling mud to be routed to the mud treatment facility when operating with a full riser level 245. There is a separate system (not shown) that ensures that the gas is handled in a safe manner when the annular sealing element 38 is used. This is often referred to as the diverter system. The annular sealing element 38 is part of any drilling rig and not specific to the SBP system. The mudline 60 is used to route mud back to a mud treatment facility during conventional drilling operations.

At a position between the top of the riser 1 and the outlet 6 there is a rotary sealing device (RSD) 15, which in this specification generally is referred to as sealing element. The rotary sealing device 15 is able to seal across the annulus 5 of the riser 1 and at the same time allow rotation of the drill string 4.

An additional annular seal 16, which is designed to seal around a non-rotating drill string 4. This seal 16 is used when the RSD 15 is to be changed and can also act as a safety measure if the RSD fails.

When operating the system of FIG. 1, the RSD is kept closed. Mud that has been pumped down the drill string 4 and returns up the annulus 5 is diverted out of the riser through the mud return line 108. The choke 113 is adjusted to maintain a certain pressure in the well.

The pressure below the RSD 15 is greater than atmospheric pressure. If there is a leakage across the RSD, there will be a leakage of well fluids to atmosphere and control methods, such as closing seal 16 and changing the RSD 15, are required.

The subsea specialized equipment for SBP is monitored and controlled through umbilical 180.

In FIG. 1, a configuration is shown where the RSD 15 and annular seal 16 are located on a special riser joint 136 between flanges 35 and 37, with the outlet 6 located on a separate joint 33 located between flanges 34 and 35. This is just an example of how the subsea specialized equipment for SBP could be arranged.

This known system has a number of advantages but does also have a number of drawbacks, as indicated in the section Background Art above.

Figure 2:
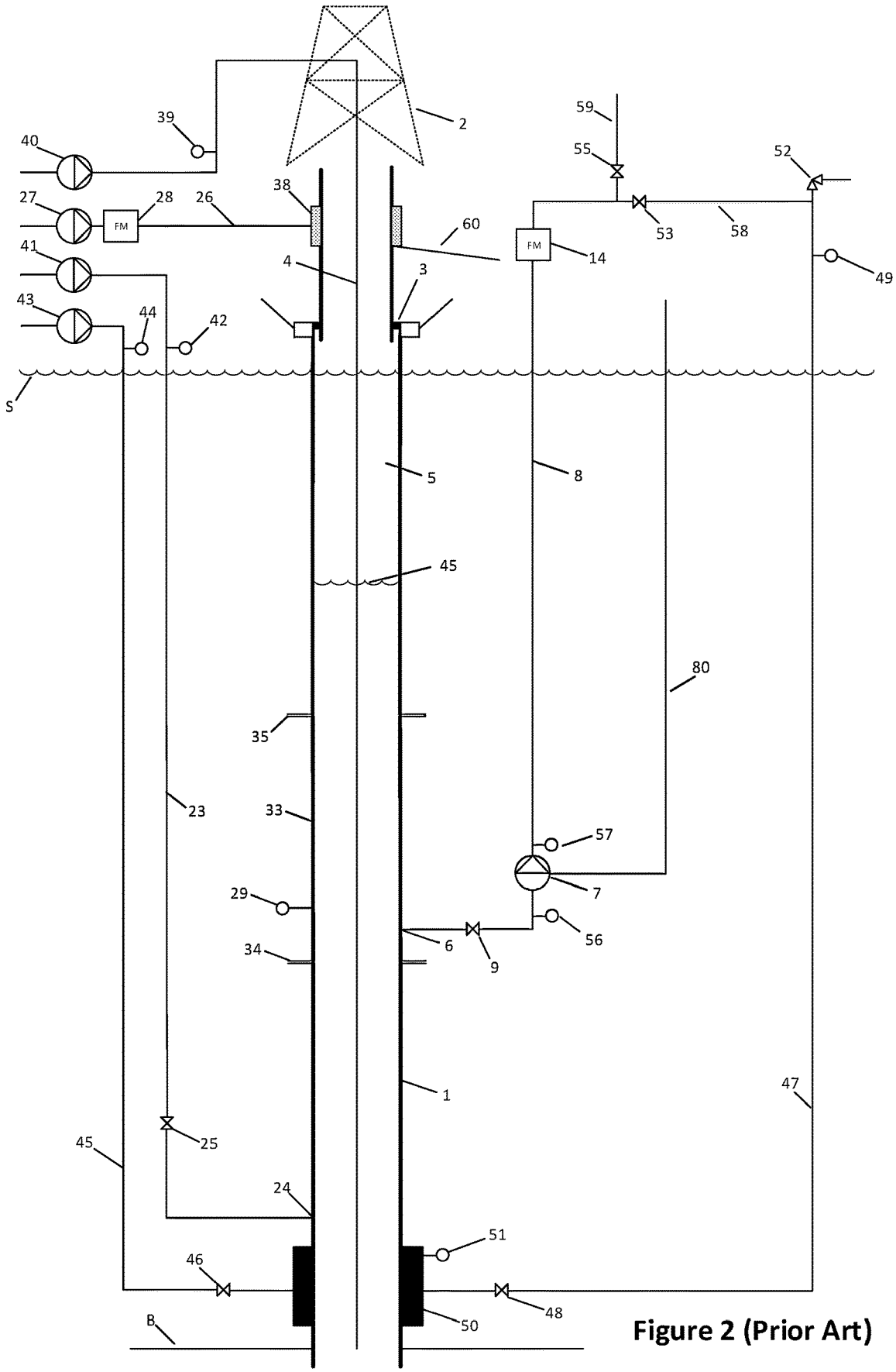
Figure 2 (Prior Art)
FIG. 2 shows schematically a prior art system of an open pumped riser type according to the so-called Controlled Mud Level (CML) type without any riser sealing element

FIG. 2 shows another known system, which is designed to operate in the pumped riser open mode. The system may also be denoted a CML (Controlled Mud Level) system. In this system the pressure in the well is controlled by controlling the level of mud in the riser.

As for the system of FIG. 1, FIG. 2 shows a drilling riser 1 extending from a drilling platform or vessel 2 at a surface S of a body of water to a bottom B of the body of water. The drilling riser 1 contains a slip joint 3 that is adapted to take up relative movement between the drilling platform or vessel 2 and the riser 1.

A drill string 4 extends along the inside of the drilling riser 1 and into the well (not shown). An annulus 5 is formed between the drill string 4 and the riser 1.

A drilling fluid, also often referred to as mud or drilling mud, is pumped down the drill string 4, out the lower end of the drill string 4 and up the annulus 5. After the mud has exited from the lower end of the drill string 4, it will become mixed with the content of the well, such as oil, gas, water, particles, rocks etc. and flow up the annulus 5. The mud is pumped down the drillstring by a rig pump (usually a set of pumps) 40. A pressure sensor 39 is conveniently arranged at the outlet of the rig pump 40.

A choke line 47 extends from a BOP 50. The choke line 47 has an isolation valve 48 and a pressure sensor 49. The choke line 47 is coupled to a rig choke 52.

A kill line 45 is coupled to the BOP 50 via an isolation valve 46. At the upper end of the kill line 45 is a kill liquid pump 43 and a pressure sensor 44.

A boost line 23 is coupled to an inlet 24 that is arranged close to the BOP 50. The line 23 has isolation valve 25 and is supplied by a boost pump 41. A pressure sensor 42 is included in the line 23.

At a depth below the surface S there is an outlet 6 from the riser 1. The outlet is coupled to a mud return line 8 with an isolation valve 9. The mud return line 8 extends to the platform 2, where there is a flowmeter 14 mounted on the mud return line 8. In normal operations, the mud is routed to the mud treatment system through a line 59 with a valve 53 closed and a valve 55 open.

As an alternative, the mud may be routed to the mud treatment system through a line 58 and the rig choke 52, with the valve 55 closed and the valve 53 open.

One or more pressure sensors 29 are arranged in the riser. There is also a pressure sensor 51 on the BOP.

The outlet 6 and pressure sensor 29 are part of a specialty riser joint 33 that is different to the rest of the riser joints being used. The specialty riser joint 33 is mounted in the riser 1 using regular riser flanges 34 and 35.

At the top of the riser 1 there is a flowline 60 for return mud and an annular sealing element 38. The annular sealing 38 element is used to close the riser annulus 5 if gas should rise to the top of the riser 1. There is a separate system (not shown) that ensures that the gas is handled in a safe manner when the annular sealing element 38 is used. This is often referred to as the diverter system.

There is also a fill line 26 that is coupled to the top of the riser 1. A pump 27 may pump mud through the fill line 26. A flow meter 28 or other method of measuring flow is used to keep control of the amount of mud pumped into the riser 1.

When operating the system of FIG. 2, the riser 1 is normally kept open to atmospheric pressure at the top. The level of mud 45 in the riser 1 is controlled by the return pump 7 based on the desired pressure in the well.

There is mounted a pressure sensor upstream 56 and downstream 57 of the pump 7. Sensors 56 and 57 can be used to calculate the pressure generated by the pump 7

An umbilical 80 extends from the platform 2 down to the pump 7. The umbilical supplies power to pump 7 and also conveys signals and power subsea to CML components such as the riser mounted pressure sensor 29, the isolation valve 9, and the pressure sensors 56 and 57 on either side of the pump 7.

This system has many advantages but has also some drawbacks. Among the drawbacks are difficulties associated with handling gas influxes that have entered the riser above the BOP, although there exist ways to handle such situations, which will not be described herein.

Figure 2A:
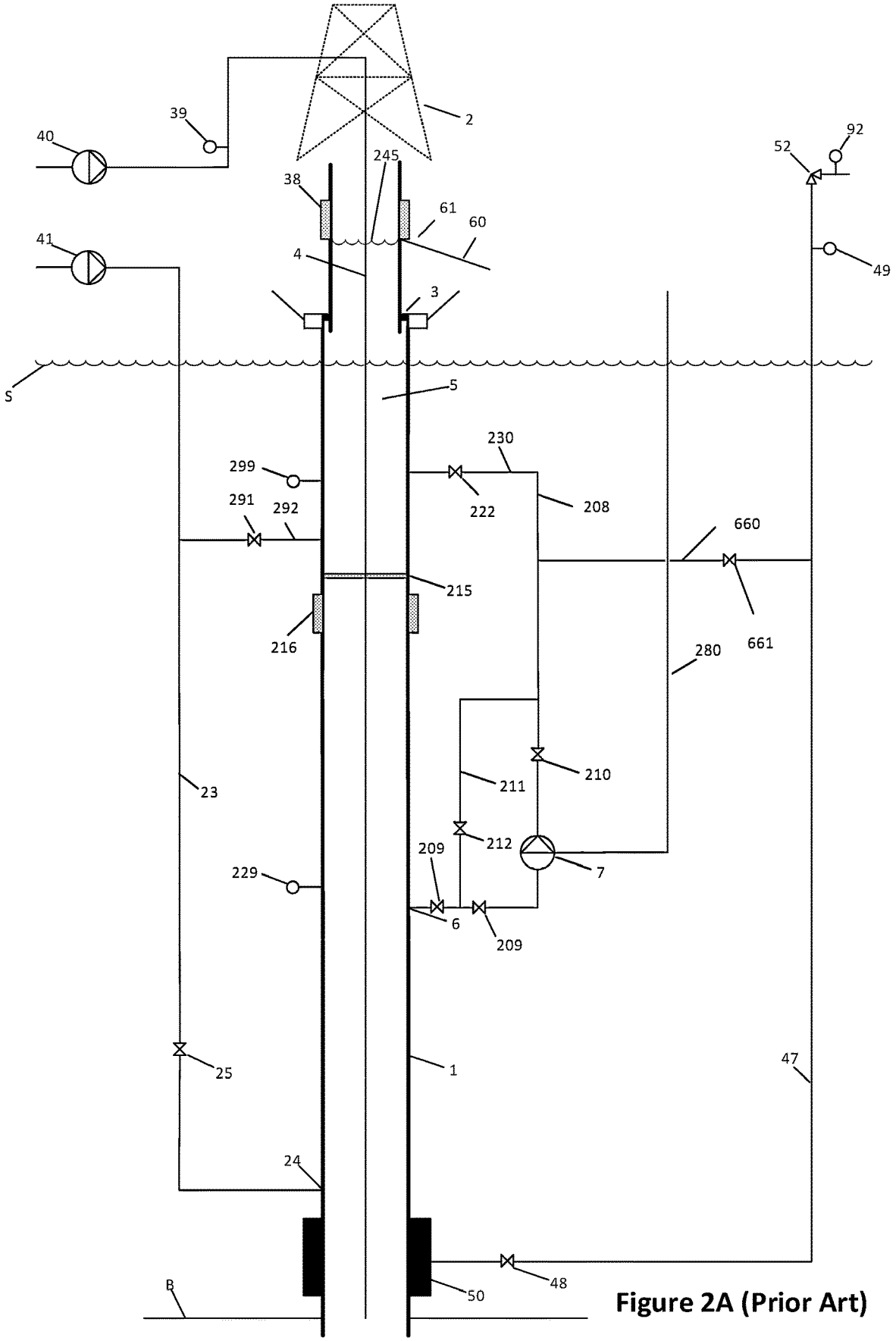
Figure 2A (Prior Art)
FIG. 2*a* shows schematically a prior art system of a closed pumped riser type with a riser sealing element

FIG. 2*a* is a schematic representation of yet another prior art drilling riser system. This is based on a presentation by Statoil and AGR at the SPE/IACD MPD UBO conference held 8-9 Apr. 2014 in Madrid. A paper on the same concept was presented at Offshore Technology Conference in 2014, documented in paper OTC-25292-MS. Features described in the paper, which are not relevant have been excluded, and the figure shows an interpretation of the relevant parts.

FIG. 2A shows a drilling riser 1 extending from a drilling platform or vessel 2 at a surface S of a body of water to a bottom B of the body of water. The drilling riser 1 contains a slip joint 3 that is adapted to take up relative movement between the drilling platform or vessel 2 and the riser 1.

A drill string 4 extends along the inside of the drilling riser 1 and into the well (not shown). An annulus 5 is formed between the drill string 4 and the riser 1.

Mud is pumped down the drill string 4, out the lower end of the drill string 4 and up the annulus 5. After the mud has exited from the lower end of the drill string 4, it will become mixed with the content of the well, such as oil, gas, water, particles, rocks etc. and flow up the annulus 5. The mud is pumped down the drill string 4 by a rig pump (usually a set of pumps) 40. A pressure sensor 39 is conveniently arranged at the outlet of the rig pump 40.

At a depth there is a first outlet 6 to which a return pump 7 is coupled. The downstream end of the return pump 7 is coupled to a return line 208 which connects to a line 230 that is connected to the riser 1. The pump 7 has an upstream isolation valve 209 and a downstream isolation valve 210

A pump bypass line 211 is also included. The pump bypass line 211 has an isolation valve 212.

There is a riser outlet line isolation valve 209 and a riser inlet isolation valve 222

In FIG. 2A is also shown a choke line 47 extending from a BOP 50. The choke line 47 has an isolation valve 48 and a pressure sensor 49. The choke line 47 is coupled to a rig choke 52. There is a pressure sensor 92 downstream the rig choke 52.

From line 208 there is also a branch line 660 to the choke line 47. There is an isolation valve 661 on the branch line 660.

At a position higher up the riser 1 from the riser outlet 6 and below the inlet line 220, is arranged a Rotating Control Device (RCD) 215. The RCD 15 is typically placed at 900-1600 ft (about 275-50 meters) below Rotary Kelly Bushing (RKB) (not shown).

Below the RCD 215 could also be located an optional riser annular 216.

At the top of the riser 1, below the diverter 38, is located an outlet 61 commonly known as a bell-nipple. This is connected to a flowline 60 that allows the drilling mud to be routed to the mud treatment facility when operating with a full riser level 245.

The riser is equipped with pressure sensors 229 and 299. The pressure sensor 229 is below the RCD 215 and pressure sensor 299 is above the RCD 215.

The pump 7 receives power through an umbilical 280 from the surface. The umbilical also contains power and signal cables to operate and monitor the subsea valves and sensors.

In this prior art system, mud is returned to the surface through the riser during drilling. In an upset scenario, where riser gas needs to be handled by the system, the choke line may be used to handle the gas by isolating and bypassing the subsea pump and taking returns up the choke line, whilst pumping down the boost line and regulating the pressure in the riser using the rig choke.

A boost line 23 is coupled to an inlet 24 that is arranged close to the BOP 50. The line 23 has isolation valve 25 and is supplied by a boost pump 41. There is a branch line 292 from the boost line 23 to the riser 1, with an inlet above the RCD 215.

There is an isolation valve 291 on the branch line 292.

DETAILED DESCRIPTION OF THE INVENTION

In the following description it should be noted that whereas only one isolation valve is described to close a particular line, it is common practice to install at least two isolation valves at critical locations. Consequently, "a valve" should be construed as meaning "one of more valves".

Moreover, the drawings are not to scale, as the vertical distance will be much larger compared to the diameter of the riser than shown in the drawing.

Within this description, the term closed riser refers to a system where the annulus is closed off within the riser, and where it is possible to operate with a pressure differential across some sealing device located within the riser. There are several methods by which the pressure differential can be created and maintained known per se to the person of skill.

Within this description, it is referred to the pump as removing pressure and the choke as adding pressure. From a physical point-of-view, within each of the two components, the opposite is what actually occurs, as the pump adds energy and pressure to the fluid and the choke dissipates, or removes, energy and pressure from the fluid. However, in the context for this invention and as is customary for the driller, we refer to the effect on the wellbore pressure from operating the pump or the choke.

The terms "mud" and "drilling fluid" are used alternatingly to denote drilling fluid in general. This is meant to cover all types of fluids commonly used for drilling, such as but not limited to liquids, gaseous fluids, gas and liquid mixtures, foam, emulsified water and/or oil, water-based, oil-based, gaseous and synthetic-based drilling fluids. The systems of the present invention may also be used for other purposes than drilling, such as cementing, completions, injection, hydration prevention or fracking, and hence fluids associated with these operations may also be used instead of or in addition to drilling fluid.

When in this specification, including the claims, the term "coupling" or "coupled" is used, it is to be understood as "fluidly coupling".

When in this specification specialized equipment, such as the return pump 7 or return lines, additional to a conventional hardware set-up are described as mounted on the riser, these components could alternatively be mounted adjacent to the riser, e.g. suspended from the drilling rig, or located on the sea-bed.

Figure 3:
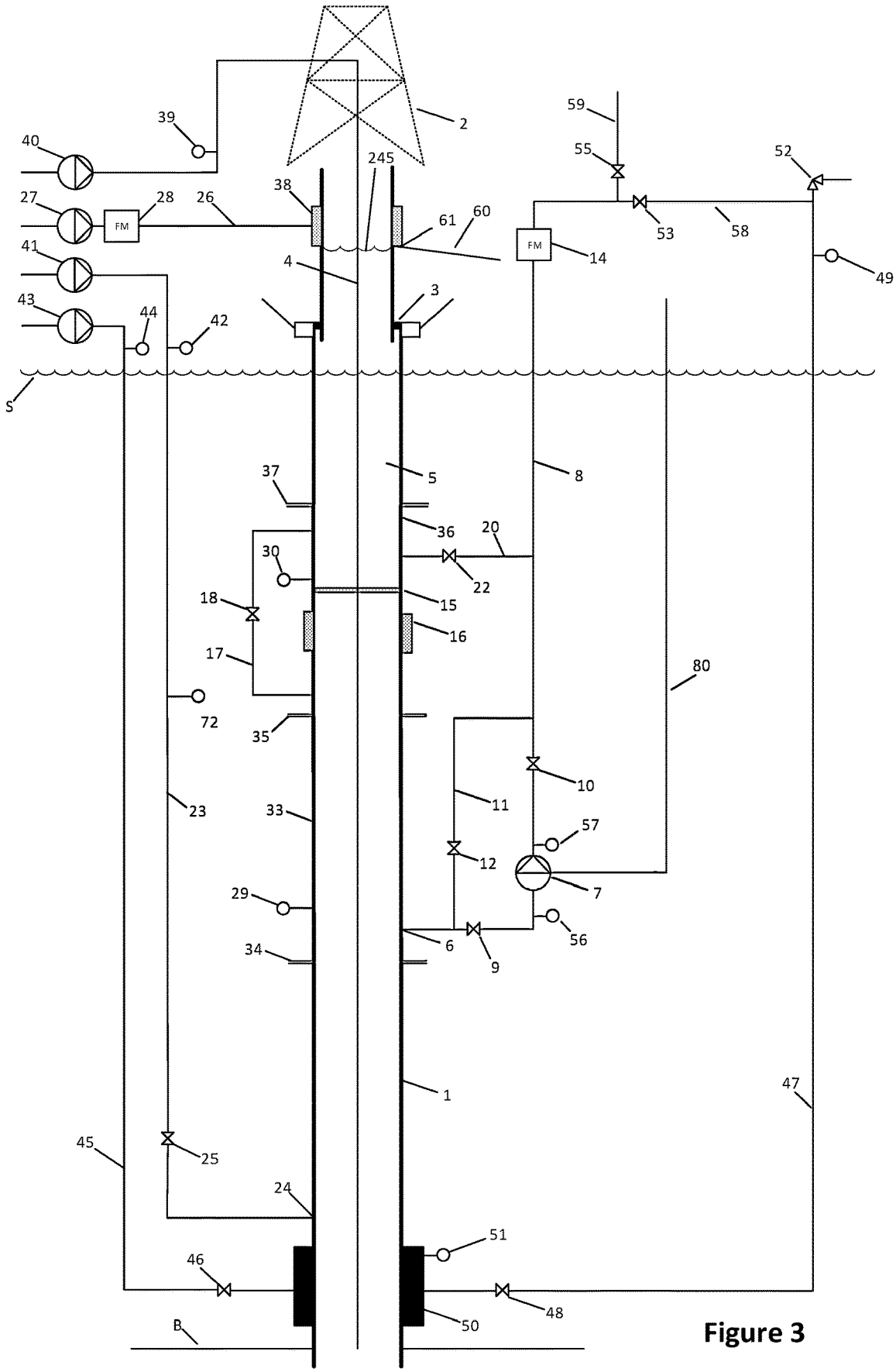
FIG. 3 shows schematically first set-up of a system according to the invention, with a pumped and closed riser.

FIG. 3 shows a first embodiment of a system according to the present invention, which to some extent can be regarded as a novel mix of the two systems of FIGS. 1 and 2.

FIG. 3 shows a drilling riser 1 extending from a drilling platform or vessel 2 at a surface S of a body of water to a bottom B of the body of water. The drilling riser 1 contains a slip joint 3 that is adapted to take up relative movement between the drilling platform or vessel 2 and the riser 1. If the drilling platform 1 is supported on the bottom B, such as a jack-up rig, the slip joint 3 can be omitted.

A drill string 4 extends along the inside of the drilling riser 1 and into the well (not shown). An annulus 5 is formed between the drill string 4 and the riser 1.

A fluid, such as drilling fluid, cement for cementing liners and casings, MEG, water, plug and abandonment cement, glycol, etc. is pumped down the drill string 4. In the following drilling mud will be used as an example. The drilling mud is pumped down the drill string 4, out the lower end of the drill string 4 and up the annulus 5. After the mud has exited from the lower end of the drill string 4, it will become mixed with the content of the well, such as oil, gas, water, particles, rocks etc. and flow up the annulus 5. The mud is pumped down the drill string 4 by a rig pump (usually a set of pumps) 40. A pressure sensor 39 is conveniently arranged at the outlet of the rig pump 40.

At a depth, that can be between 50-1000 meters, but in most current cases will be around 2-400 meters, below the water surface S there is a first outlet 6 to which a return pump 7 is coupled. The downstream end of the return pump 7 is coupled to a return line 8. The return line 8 extends to the drilling platform or vessel 2 above the surface S. It may contain a flow meter 14. The flow meter 14 can also be arranged another place along the return line 8 than shown.

Sets of isolation valves 9 and 10 are arranged to facilitate isolation of the return pump 7 at the upstream and downstream end or both.

In normal operations, the mud is routed to the mud treatment system through line 59 with valve 53 closed and valve 55 open.

In the figure is also a choke line 47 extending from a BOP 50, shown. The choke line has an isolation valve 48 and a pressure sensor 49. The choke line 47 is coupled to a rig choke 52.

The return line 8 is also coupled to the rig choke 52 via a line 58. The valves 55 and 53 can be used to determine where the return flow should be directed.

A pump bypass line 11 is also included. The pump bypass line 11 has an isolation valve 12. Hence the drilling fluid can either be pumped to the surface via the return pump 7 when the valves 9 and 10 are open and the valve 12 is closed, or flow by its own pressure through the pump bypass line 11 when at least one of the set of valves 9, 10 (or preferably both) are closed, and the valve 12 is open.

A pressure sensor 56 is arranged on the inlet side of the return pump 7 and a pressure sensor 57 is arranged on the outlet side of the pump 7.

An umbilical 80 provides power to drive the pump, in addition to signal paths and power to operate the sensors, valves and sealing elements. The power supply can be hydraulic or electric, depending on the type of pump used.

At a position higher up the riser 1 from the return pump 7, but still substantially below the surface, is arranged a sealing device 15, which is of a type that seals around the drill string 4, also when the drill string 4 is rotating. Such closing devices are sometimes called Rotary Closing Device (RCD), In the following we will use the more generic term Rotary Sealing Device (RSD) 15.

The riser may also have an additional sealing element in the form of an annular seal 16, which is a device with a similar functionality as an RSD, but which is not designed to operate for any length of time with rotation of the drill string 4. It is primarily designed to operate without rotation of the drill string 4. Whereas the RSD 15 is typically installed and retrieved with the drill string 4, the annular seal 16 is installed with the riser 1. More than one RSD can be installed, as well as more than one annular seal. The annular seal 16 is designed to seal around a non-rotating drill string 4. The annular seal 16 may be used for shorter periods instead of the RSD, also with a rotating drill string 4. The RSD 15 and annular seal 16 can be arranged in any order. It is also conceivable to have the RSD located within the annular seal.

A by-pass line 17 is arranged to bypass the RSD 15 and the annular seal 16. The by-pass line 17 has a valve 18 that can be opened to allow well fluids to flow through the by-pass line 17.

The return line 8 is also connected to the riser 1 above the RSD 15 and annular seal 16, via an upper branch line 20. The branch line 20 has an isolation valve 22.

The arrangement may have a conventional kill line 45 that is coupled to the BOP 50 via an isolation valve 46. At the upper end of the kill line 45 is a kill liquid pump 43 and a pressure sensor 44.

A boost line 23 extends from the surface to an inlet 24 on the riser 1. The inlet 24 is positioned substantially below the pump outlet 6, preferably close to the lower end of the riser 1. The boost line 23 is equipped with one or more isolation valves 25. The boost line 23 is also equipped with a pressure sensor 72 that allows for measuring the level of liquid in the boost line.

Any suitable line, such as kill, choke, or other existing line on the riser may be used as a fill line instead of the boost line 23. Alternatively, a dedicated fill line may be installed A fill pump 41 is arranged to pump liquid down the boost line 23. A pressure sensor 42 is included in the line 23.

The system of FIG. 3 has also an upper fill line 26 that is coupled to the top of the riser 1, typically through an existing opening in the diverter 38. A pump 27 may pump mud through the fill line 26. A flow meter 28 is used to keep control of the amount of mud pumped into the riser 1.

At the top of the riser 1, below the diverter 38, is located an outlet 61 commonly known as a bell-nipple. This is connected to a flowline 60 that when operating with a full riser level allows the drilling mud to be routed to the mud treatment facility.

The system may operate with the riser level 245 at the height of the bell-nipple, or any other location down to the riser outlet 6.

The riser is equipped with pressure sensors and/or level sensors, such as sensors 29, 30. The sensor 29 is a pressure sensor, while the sensor 30 may be a pressure sensor or a level sensor. Such sensors are well known in the art per se. The pressure sensor 29 is below the RSD 15 and annular seal 16. The sensor 29 may also be arranged on the BOP 50. Alternatively, an additional pressure sensor 51 may be arranged on the BOP 50. Pressure/level sensor 30 is arranged above the RSD 15.

The pump 7 receives power through an umbilical 80 from the surface. The umbilical also contains power and signal cables to operate and monitor the subsea valves and sensors and annular seals located on riser joints 33 and 36 in addition to the valves and sensors between the outlet 6 and surface S or rig 2.

In a preferred embodiment the pump outlet 6 is arranged on a first special joint 33, extending between flanges 34 and 35. The RSD 15, annular seal 16, bypass 17 as well as branch lines 19, 20 and 31 are arranged on a second special joint 36 extending between flanges 35 and 37. All these items may alternatively be included in one joint.

A second embodiment of the invention will now be described in greater detail referring to the schematic set-up of FIG. 4. The set-up is similar to the set-up in FIG. 3, but for the following:

The return line 8 extending to the drilling platform or vessel 2 above the surface S contains an additional choke 13 upstream of the rig choke 52. An additional isolation valve 54 is also included. This couples the return line 8 to the rig choke 52 so that flow from the return line can be directed through the additional choke 13 to the rig choke 52. The isolation valves 53, 54, 55 are used to determine where the return flow should be directed, depending on the gas content in the flow. If the gas content is above a certain amount, or if a high gas content is expected, the flow is directed through the chokes 13 and 52. The choke 13 is fitted with an upstream pressure sensor 90 and a downstream pressure sensor 91

The embodiment of FIG. 4 includes a lower branch line 19 that can also be used to bypass the pump 7, as will be explained further below.

The return line 8 is thus connected to the riser 1 both below the RSD 15 and annular seal 16 and above the RSD 15 and annular seal 16, via the lower branch line 19 and the upper branch line 20, respectively. Both branch lines 19, 20 have isolation valves 21, 22.

The boost line 23, or alternative line used as fill line, is also coupled to the riser 1 at a level above the RSD 15 via a branch line 31, which is equipped with an isolation valve 32 to form a lower fill line.

The system will normally operate with a riser level 145 below the slip joint 3. The riser level 145 may be operated anywhere between the riser outlet 6 and the bell-nipple 61.

Figure 4:
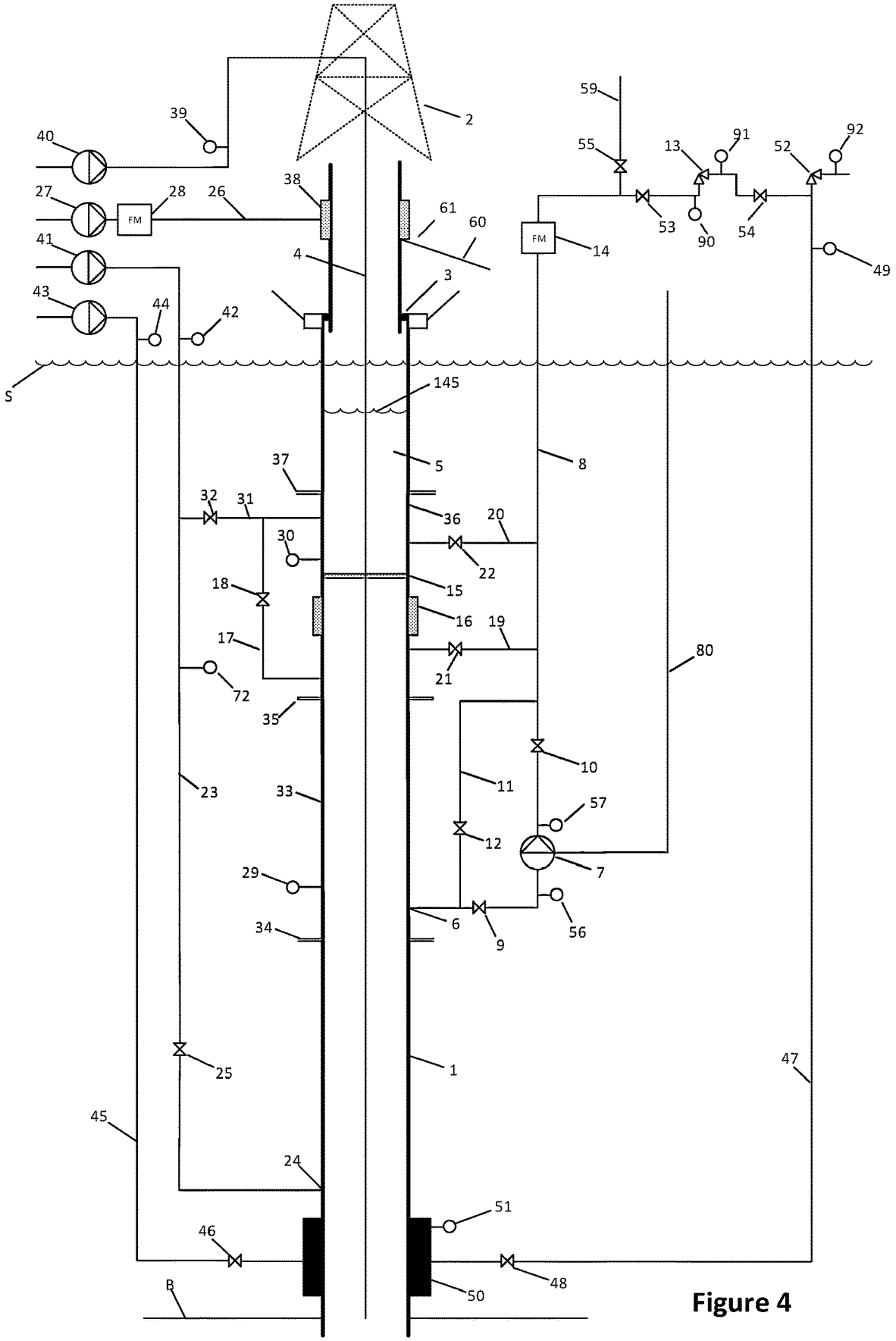
FIG. 4 shows schematically a second set-up a system according to the present invention, where an auxiliary line can be used

The system may include all of the additional features shown in FIG. 4 or only some of them.

A third embodiment of the invention will now be described in greater detail referring to the schematic set-up of FIG. 5. The set-up is similar to the set-up in FIG. 4, with some additional features.

Figure 5:
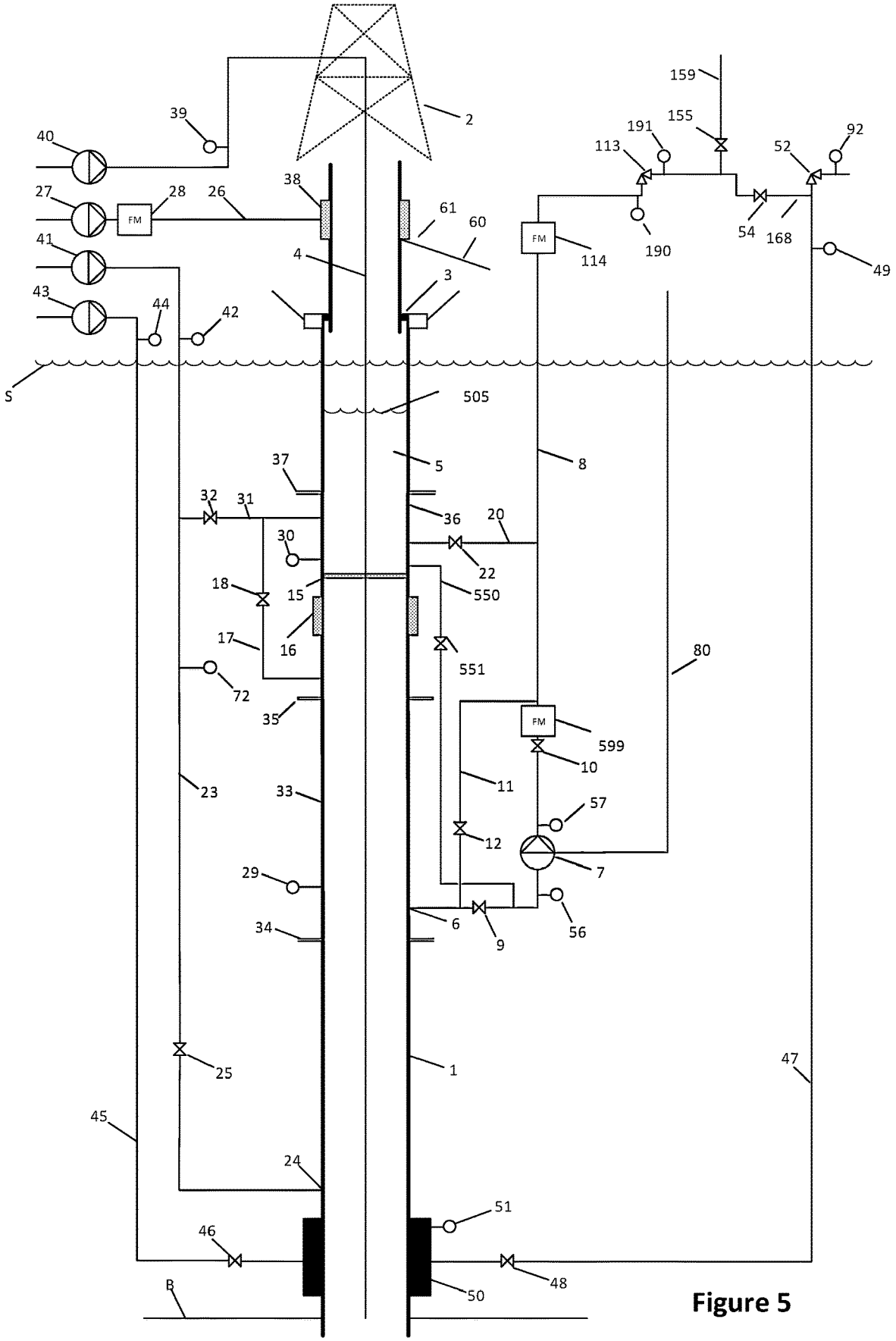
FIG. 5 shows schematically a third set-up of a system according to the present invention where further features are introduced into the system

FIG. 5 shows a drilling riser 1 extending from a drilling platform or vessel 2 at a surface S of a body of water to a bottom B of the body of water. The drilling riser 1 contains a slip joint 3 that is adapted to take up relative movement between the drilling platform or vessel 2 and the riser 1. If the drilling platform 2 is supported on the bottom B, such as a jack-up rig, the slip joint 3 can be omitted.

A drill string 4 extends along the inside of the drilling riser 1 and into the well (not shown). An annulus 5 is formed between the drill string 4 and the riser 1.

A fluid, such as drilling fluid, cement for cementing liners and casings, MEG, water, plug and abandonment cement, glycol, etc. is pumped down the drill string 4. In the following drilling mud will be used as an example. The drilling mud is pumped down the drill string 4, out the lower end of the drill string 4 and up the annulus 5. After the mud has exited from the lower end of the drill string 4, it will become mixed with the content of the well, such as oil, gas, water, particles, rocks etc. and flow up the annulus 5. The mud is pumped down the drill string 4 by a rig pump (usually a set of pumps) 40. A pressure sensor 39 is conveniently arranged at the outlet of the rig pump 40.

At a depth, that can be between 50-1000 meters, but in most current cases around 2-400 meters, below the water surface S there is a first outlet 6 to which a return pump 7 is coupled. The downstream end of the return pump 7 is coupled to a return line 8. The return line 8 extends to the drilling platform or vessel 2 above the surface S. It may contain a flow meter 114. The flow meter 114 can also be arranged another place along the return line 8, for example at the pump 7 outlet, shown as flowmeter 599.

Sets of isolation valves 9 and 10 are arranged to facilitate isolation of the return pump 7 at the upstream and downstream end or both.

A pump bypass line 11 is also included. The pump bypass line 11 has an isolation valve 12. Hence the drilling fluid can either be pumped to the surface via the return pump 7 when the valves 9 and 10 are open and the valve 12 is closed, or flow by its own pressure through the pump bypass line 11 when at least one of the set of valves 9, 10 (or preferably both) are closed, and the valve 12 is open.

There is mounted pressure sensors upstream 56 and downstream 57 of the pump 7. Sensors 56 and 57 can be used to calculate the pressure generated by pump 7

In normal operations, the mud is routed to the mud treatment system through line 159 with valve 54 closed and valve 155 open. Alternatively, the mud from return line 8 can be routed to the rig choke 52 through line 168 with isolation valve 155 closed and isolation valve 54 open. There is a pressure sensor 92 downstream the rig choke 52. The mud could also be routed to the mud gas separator either through lines 159 or 168 and further on piping routes not shown on FIG. 5.

In FIG. 5 is also shown a choke line 47 extending from a BOP 50. The choke line has an isolation valve 48 and a pressure sensor 49. The choke line 47 is coupled to the rig choke 52.

At a position higher up the riser 1 from the riser outlet 6 but still substantially below the surface, is arranged an RSD 15.

The riser may also have an additional sealing element in the form of an annular seal 16, which is a device with a similar functionality as an RSD, but which is not designed to operate for any length of time with rotation of the drill string 4. It is primarily designed to operate without rotation of the drill string 4. Whereas the RSD 15 is typically installed and retrieved with the drill string 4, the annular seal 16 is installed with the riser 1. More than one RSD can be installed, as well as more than one annular seal. The annular seal 16 is designed to seal around a non-rotating drill string 4. The annular seal 16 may be used also with a rotating drill string 4 for shorter periods instead of the RSD 15. The RSD 15 and annular seal 16 can be arranged in any order. It is also conceivable to have the RSD 15 located within the annular seal.

A by-pass line 17 is arranged to bypass the RSD 15 and the annular seal 16. The by-pass line 17 has an isolation valve 18 that can be opened to allow well fluids to flow through the by-pass line 17.

The return line 8 is also connected to the riser 1 above the RSD 15 and annular seal 16, via an upper branch line 20. The branch line 20 has an isolation valve 22.

The arrangement may have a conventional kill line 45 that is coupled to the BOP 50 via an isolation valve 46. At the upper end of the kill line 45 is a kill liquid pump 43 and a pressure sensor 44.

A boost line 23 extends from the surface to an inlet 24 on the riser 1. The inlet 24 is positioned substantially below the pump outlet 6, preferably close to the lower end of the riser 1. The boost line 23 is equipped with one or more isolation valves 25. The boost line 23 is also equipped with a pressure sensor 72 that allows for measuring the level of liquid in the boost line.

Any suitable line, such as kill, choke, or other existing line on the riser may be used as a fill line instead of the boost line 23. Alternatively, a dedicated fill line may be installed A fill pump 41 is arranged to pump liquid down the boost line 23. A pressure sensor 42 is included in the line 23.

The system of FIG. 5 has also an upper fill line 26 that is coupled to the top of the riser 1, typically through an existing opening in the diverter 38. A pump 27 may pump mud through the fill line 26. A flow meter 28 is used to keep control of the amount of mud pumped into the riser 1.

At the top of the riser 1, below the diverter 38, is located an outlet 61 commonly known as a bell-nipple. This is connected to a flowline 60 that when operating with a full riser level allows the drilling mud to be routed to the mud treatment facility.

The riser is equipped with pressure sensors and/or level sensors, such as sensors 29 and 30. Sensor 29 is a pressure sensor, while sensor 30 may be a pressure sensor or a level sensor. Such sensors are well known in the art per se. The pressure sensor 29 is below the RSD 15 and annular seal 16. The sensor 29 may also be arranged on the BOP 50. Alternatively, an additional pressure sensor 51 may be arranged on the BOP 50. Pressure/level sensor 30 is arranged above the RSD 15.

The pump 7 receives power through an umbilical 80 from the surface. The umbilical also contains power and signal cables to operate and monitor the subsea valves and sensors and annular seals located on riser joints 33 and 36 in addition to the valves, sensors and other equipment for this invention shown between the outlet 6 and surface S on FIG. 5.

In a preferred embodiment the pump outlet 6 is arranged on a first special joint 33, extending between flanges 34 and 35. The RSD 15, annular seal 16 , pressure or level sensor 30, pressure sensor 72 as well as branch lines 17, 20, 31 and 550 with isolation valves 32, 22, 18 and 551 are arranged on a second special joint 36 extending between flanges 35 and 37. All these items may alternatively be included in one joint from flanges 34 to 37.

The mud level 505 in the riser is typically kept below the slip joint 3 but could for certain operations be raised to the bell-nipple 61.

A choke 113 is located on the return line 8. Pressure sensors 190 and 191 are located upstream and downstream of choke 113. These can be used to calculate the pressure drop across the choke 113. The system could also include a by-pass arrangement around the choke 113 (not shown on drawing)

The flowmeter 114 is shown upstream the choke 113. This flowmeter 114 may also be located downstream the choke 113.

The pressure sensor 29 can be used to measure the pressure in the riser below the location of the RSD 15 or the annular sealing device 16. With the system in open mode this pressure is driven by the riser level and the mud weight. In a closed mode, this pressure can be regulated by the pump, the choke or both in combination.

The pressure or level sensor 30 measures the mud level above the sealing devices and can be used to monitor the upper riser when operating in closed mode.

The boost line 23, or alternative line used as fill line, is also coupled to the riser 1 at a level above the RSD 15 via a branch line 31, which is equipped with an isolation valve 32 to form a lower fill line.

With the system in closed mode, i.e. with the RSD 15 in place and the bypass valve 18 closed, pump 7 can maintain the pressure below the RSD 15 anywhere between that of a return line 8 full of a mud column and the minimum suction pressure allowed by the pump, typically around 1 bara. The pressure at the outlet 6 below the RSD 15 may be higher, equal to or lower than the pressure above the RSD 15. Compared to Dual Gradient concepts described in prior art, it is also significant that pressures at the riser outlet 6 lower than that of a sea-water gradient can be achieved, i.e. a water column from the bell-nipple.

By operating the choke 113, back-pressure can be added to return line 8. When operating the choke 113, the pump 7 may be used to generate some pressure boost, stopped so that no pressure boost is generated, or isolated by closing isolation valves 9 and 10 and opening isolation valve 12 to allow flow past the pump 7. Closing the isolation valves 9 and 10 to isolate the pump 7, will in some cases increase the maximum pressure rating of the system, as the pump will in some cases be the system component with the lowest pressure rating.

With this unique combination of the subsea pump 7 and choke 113, pressure can both be added and subtracted from that of a full riser in a seamless manner, giving the system an ability to regulate pressure up or down from that of a full riser, which has hitherto not been possible with prior art solutions. This is important for the driller as it increases the operational window and also gives them more flexibility with regards to choosing mud weight and still being able to keep the bottomhole pressure within the drilling window at all time. The control algorithms to synchronize the choke 113 and the pump 7 to operate in a seamless manner will be familiar to the person skilled in the art.

Next, will be described how to control the level above the RSD 15, also when operating in closed mode. FIG. 5 shows a riser outlet line 550 (which also can be denoted upper riser suction line), with an outlet from the riser 1 located above the RSD 15. Riser outlet 550 allows the driller to reduce the riser level 505 also when the RSD 15 is in place and the bypass valve 18 is closed.

This is done by opening isolation valve 551, keeping isolation valves 9 and 12 closed, open isolation valve 10 and operate the pump 7. Fluid can then be drained from the upper part of the riser 1. By operating the system in such a manner, the driller can reduce the riser Level 505. The driller can also use this feature in conjunction with either the pump 27 or the pump 41, or both, to fill new liquid into the upper part of the riser, above RSD 15, in order raise the level 505, to change mud weight, or alter other properties of the mud in the riser.

Once the driller has finished circulating the mud above the RSD 15, isolation valve 551 can be closed and isolation valve 9 or isolation valve 12 can be opened to continue operations. There could be a number of reasons why the driller would want to circulate the liquid above RSD 15. Examples include reducing the liquid level above the RSD 15 prior to opening the RSD by-pass line 18, either to reduce the riser level 505 to a lower level than what was the case prior to closing the by-pass line 18 the last time, or to remove liquid that has leaked across RSD 15 during operations.

With the method described above it is also possible to have a mud above the RSD 15 with properties different to the mud below the RSD 15. Of particular interest to the driller would be the ability to add static pressure to the well without changing out the full mud system, to add pressure above the RSD 15 as additional barrier, or in some cases to operate with a lower density mud than for the rest of the well in the upper portion of the riser.

Prior art describes how pressure control can be obtained by using a pumped riser system with a sealing device installed where suction is drawn from below the sealing device and discharged into the riser above the sealing device. An example of such a system is shown in the previously described FIG. 2*a*. When operating such a system, drill cuttings may accumulate on top of the sealing device. Since there typically is a driving pressure differential from above to below the sealing device, these drill cuttings represent a problem to the driller as they can cause wear and damage to the sealing device. This problem has been known for a long time, and various devices have been described in prior art.

In prior art pumped riser systems, as the system shown in FIG. 2*a*, where the objective has been to reduce rig integration cost by not adding a dedicated return line, one has either used the riser as the return conduit without the ability to reduce the riser level or used an existing auxiliary line, such as the boost line, as the return line. When using an existing auxiliary line, it has not been possible to operate the pumped riser system to regulate wellbore pressures at the same time as said auxiliary line has been used for its originally intended function. The current invention provides a solution to these gaps in prior art.

A fourth embodiment of the invention will now be described in detail, referring to FIG. 6.

In this embodiment of the invention is introduced a unique combination of using an existing auxiliary line, typically the boost line, in combination with a riser insert to create a flushing system that ensures that drill-cuttings will not accumulate on top of the sealing device causing damage and wear.

in this embodiment is also introduces the possibility of alternatingly using an auxiliary line for three different purposes, either using it for its originally intended purpose, or as an injection line for the flushing system (as described above) or as a return line for mud laden with cuttings. The first two purposes mentioned here may also be used simultaneously.

Figure 6:
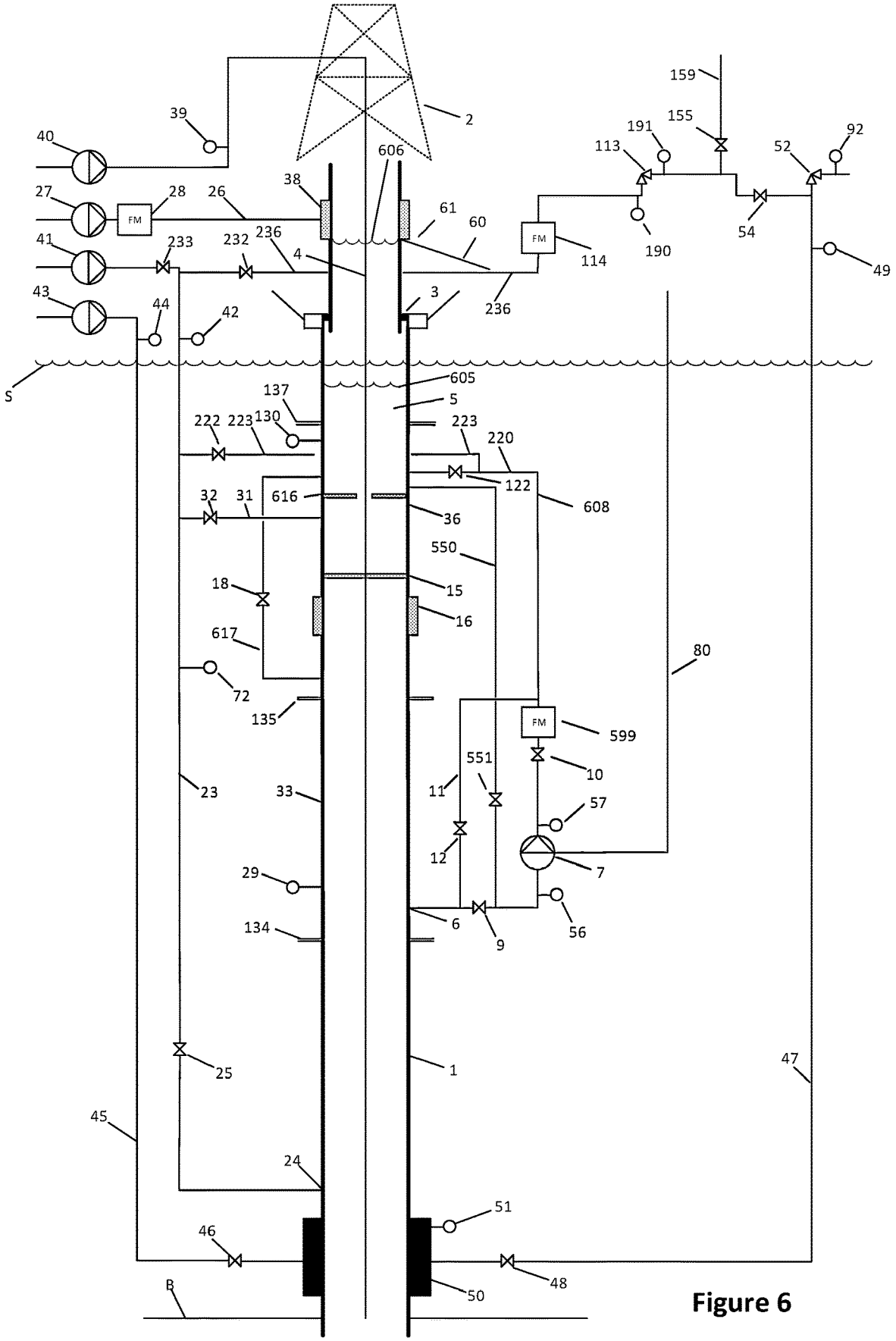
FIG. 6 shows schematically a fourth set-up of a system, that enables operation of the invention with less hardware modifications to existing equipment than for the concepts shown in FIGS. 3-5.

FIG. 6 shows a drilling riser 1 extending from a drilling platform or vessel 2 at a surface S of a body of water to a bottom B of the body of water. The drilling riser 1 contains a slip joint 3 that is adapted to take up relative movement between the drilling platform or vessel 2 and the riser 1. If the drilling platform 2 is supported on the bottom B, such as a jack-up rig, the slip joint 3 can be omitted.

A drill string 4 extends along the inside of the drilling riser 1 and into the well (not shown). An annulus 5 is formed between the drill string 4 and the riser 1.

A fluid, such as drilling fluid, cement for cementing liners and casings, MEG, water, plug and abandonment cement, glycol, etc. is pumped down the drill string 4. In the following drilling mud will be used as an example. The drilling mud is pumped down the drill string 4, out the lower end of the drill string 4 and up the annulus 5. After the mud has exited from the lower end of the drill string 4, it will become mixed with the content of the well, such as oil, gas, water, particles, rocks etc. and flow up the annulus 5. The mud is pumped down the drill string 4 by a rig pump (usually a set of pumps) 40. A pressure sensor 39 is conveniently arranged at the outlet of the rig pump 40.

At a depth, that can be between 500-1000 meters, but in most current cases around 2-400 meters, below the water surface S there is a first outlet 6 to which a return pump 7 is coupled. The downstream end of the return pump 7 is coupled to a return line 608. The return line 608 connects to line 220 which is connected to the riser 1 and through line 223 to an auxiliary line 23. By selectively operating isolation valves 122 and 222, the driller can select which flow path is open. Line 608 may have a flowmeter 599 mounted close to the pump 7.

Sets of isolation valves 9 and 10 are arranged to facilitate isolation of the return pump 7 at the upstream or downstream end or both.

A pump bypass line 11 is also included. The pump bypass line 11 has an isolation valve 12. Hence the drilling fluid can either be pumped to the surface via the return pump 7 when the valves 9 and 10 are open and the valve 12 is closed, or flow by its own pressure through the pump bypass line 11 when at least one of the set of valves 9, 10 (or preferably both) are closed, and the valve 12 is open.

There are mounted pressure sensors upstream 56 and downstream 57 of the pump 7. Sensors 56 and 57 can be used to calculate the pressure generated by pump 7

In normal operations, the mud is routed to the mud treatment system through the line 220 with isolation valve 122 open and up the riser 1 with a riser mud level 606 at the bell nipple 61.

In FIG. 6 is also shown a choke line 47 extending from a BOP 50. The choke line has an isolation valve 48 and a pressure sensor 49. The choke line 47 is coupled to a rig choke 52. There is a pressure sensor 92 downstream the rig choke 52.

At a position higher up the riser 1 from the riser outlet 6 but still substantially below the surface, is arranged an RSD 15.

The riser may also have an additional sealing element in the form of an annular seal 16, which is a device with a similar functionality as an RSD, but which is not designed to operate with rotation of the drill string 4 for any length of time. It is primarily designed to operate without rotation of the drill string 4. Whereas the RSD 15 is typically installed and retrieved with the drill string 4, the annular seal 16 is installed with the riser 1. More than one RSD can be installed, as well as more than one annular seal. The annular seal 16 is designed to seal around a non-rotating drill string 4. The annular seal 16 may be used for shorter periods instead of the RSD, also with a rotating drill string 4. The RSD 15 and annular seal 16 can be arranged in any order. It is also conceivable to have the RSD located within the annular seal.

A riser insert 616 is mounted in the riser joint 36 located above the RSD 15. A tie-in line 31 from the auxiliary line 23 is connected to the riser joint 36, above the RSD 15 and below the riser insert 616.

The riser insert 616 has an axial cross-sectional opening area that is small compared to the internal cross-sectional area of the riser joint 36, typically 5% or less of the riser cross-section.

A by-pass line 617 is arranged to bypass the RSD 15, the annular seal 16 and the riser insert 616. The by-pass line 617 has an isolation valve 18 that can be opened to allow well fluids to flow through the by-pass line 617.

The arrangement may have a conventional kill line 45 that is coupled to the BOP 50 via an isolation valve 46. At the upper end of the kill line 45 is a kill liquid pump 43 and a pressure sensor 44.

A boost line 23 extends from the surface to an inlet 24 on the riser 1. The inlet 24 is positioned substantially below the pump outlet 6, preferably close to the lower end of the riser 1. The boost line 23 is equipped with one or more isolation valves 25. The boost line 23 is also equipped with a pressure sensor 72 that allows for measuring the level of liquid in the boost line.

Any suitable line, such as kill, choke, or other existing line on the riser may be used as a fill line instead of the boost line 23. Alternatively, a dedicated fill line may be installed A fill pump 41 is arranged to pump liquid down the boost line 23. A pressure sensor 42 is included in the line 23.

The system of FIG. 6 has also an upper fill line 26 that is coupled to the top of the riser 1, typically through an existing opening in the diverter 38. A pump 27 may pump mud through the fill line 26. A flow meter 28 is used to keep control of the amount of mud pumped into the riser 1.

At the top of the riser 1, below the diverter 38, is located an outlet 61 commonly known as a bell-nipple. This is connected to a flowline 60 that when operating with a full riser level allows the drilling mud to be routed to the mud treatment facility.

The riser is equipped with pressure sensors and/or level sensors, such as sensors 29 and 130. Sensor 29 is a pressure sensor, while sensor 130 may be a pressure sensor or a level sensor. Such sensors are well known in the art per se. The pressure sensor 29 is below the RSD 15 and annular seal 16. The sensor 29 may also be arranged on the BOP 50. Alternatively, an additional pressure sensor 51 may be arranged on the BOP 50. Pressure/level sensor 130 is arranged above the riser insert 616.

The pump 7 receives power through an umbilical 80 from the surface. The umbilical also contains power and signal cables to operate and monitor the subsea valves and sensors and annular seals located on the riser joints 33 and 36 in addition to the valves, sensors and other equipment for this embodiment, and which are arranged between the outlet 6 and surface S in FIG. 6.

In a preferred embodiment the pump outlet 6 is arranged on a first special joint 33, extending between flanges 134 and 135. The RSD 15, annular seal 16, pressure or level sensor 30, pressure sensor 72 as well as branch lines 617, 220, 223 with isolation valves 222, 122, 32 and 18 are arranged on a second special joint 36 extending between flanges 135 and 137. All these items may alternatively be included in one joint from flanges 134 to 137

When routing the return flow up the auxiliary line 23, a new topside flow path is introduced, which will be described below.

To isolate the pump 41 and ensure that no mud with cuttings enter the pump, isolation valve 233 is closed. Isolation valve 232 is opened and mud is pumped from the pump 7, through lines 608, 220, 223, 23 and 236 to a topside flowmeter 114 and through the choke 113. Here the flow can either be routed to the regular mud treatment system through line 159, with isolation valve 155 open and isolation valve 54 closed, or to the rig choke 52 with isolation valve 54 open and isolation valve 155 closed. The topside choke 113 has upstream and downstream pressure sensors 190 and 191.

The mud level in the riser 605 is typically kept below the slip joint 3 but could for certain operations be raised to the bell-nipple 61 as shown by reference number 606.

Pressure sensors 190 and 191 are located upstream and downstream of the choke 113. These can be used to calculate the pressure drop across the choke 113.

The flowmeter 114 is shown upstream the choke 113. This flowmeter 114 may also be located downstream the choke 113. This may be the case for all embodiments.

Only one return line 608 is shown. The system may have a second return line to mitigate the risk of blockage.

As an alternative to having a second return line 8, the bypass line 617, with isolation valve 18, can be used as an instrumented over-pressure protection system. This is achieved by using readings from pressure sensor 29. Isolation valve 18 will open when the pressure from the sensor 29 exceeds a pre-determined set-point.

In order to ensure that cuttings do not fall down on RSD 15 when pumping cuttings laden mud into the riser above the RSD 15, drilling fluid is pumped down auxiliary line 23 through line 31 and into the cavity in the riser 1 between RSD 15 and riser insert 616. As the RSD 15 is sealing off the annulus, the flow will be forced upwards, through the openings in the riser insert 616 and mix with the drilling fluid above. The upward flowrate through the riser insert 616 will be sufficient to create an upward velocity of drilling fluid through the openings in the riser insert 616 that is higher than the slip velocity of cuttings in the drilling mud. This flowrate will typically be 100-500 litres per minute.

The driller may want to use the boost line for its originally intended purpose of boosting the riser. This is easily facilitated by opening isolation valve 25 and closing isolation valve 32. For these operations, valve 222 is already closed. If not pumping clean mud into line 31 some cuttings could theoretically enter the cavity between riser insert 616 and RSD 15. In order to avoid this, the driller could partially open isolation valve 25 and isolation valve 32 to create the correct choking effect to allow a controlled flow into the riser through inlet 24 and into the flushing cavity through line 31 at the same time. Alternatively, the driller may opt to accept the risk of cuttings accumulating on top of RSD 15 and not circulate through line 31.

The system of FIG. 6 could also be fitted with a line 550 with an isolation valve 551 in the same fashion as described in FIG. 5, but in the case of the embodiment of FIG. 6 drawing suction from above the riser insert 616.

Various possible operational procedures utilizing the above described set-up will now be described. Most of the procedures may be performed using any of the embodiments described herein, while for some procedures a particular embodiment may be necessary. It should be evident from the explanations if a particular embodiment is referred to. Sometimes only one reference number is used for a specific component, while different reference numbers may be used for the same component in the various figures.

Quickly Changing from Closed Riser with Pressure Control and Open Riser with Controlled Mud Level (CML)

The RSD 15 is kept closed around the drill string 4, With the by-pass valve 18 closed, the pressure in the riser 1 below the RSD 15 can be controlled by adjusting the pump suction pressure.

If the situation requires or it is beneficial to change the control regime into an open system where the pressure in the well is controlled by the mud level in the riser, this can be quickly done by opening the by-pass valve 18. There is no need to retrieve the RSD 15, as it can be kept closed. As an alternative, if the RSD is designed for it, it can be opened to switch into an open system. In the open mode, the level in the riser 1 can be set at any level between the pump outlet 6 and the top of the riser 1 and be controlled by the pump 7. Thereby the pressure above the RSD 15 can be adjusted to the same as or higher pressure than below the RSD before the valve 18 in the bypass 617, 17 is opened.

It is of course also possible to go from an open riser mode to a closed riser mode by closing the by-pass valve 18.

Measuring Mud Volume by Switching Between Closed Mode and Open Mode

When the system is in closed mode, i.e. with the isolation valve 18 of the by-pass 17 closed and under pressure control, it is difficult to measure the volume of mud in the system very accurately. The current measurement methods rely on aggregating flow measurements over time, i.e. flow of mud into the well versus flow of mud out of the well and/or has uncertainties related to effects on topside volume measurement system from factors such as rig motion, heave, poor sensor resolution, pipes that are not completely filled with liquids and so on. The flow measurements have inherent inaccuracies which when combined over time leads to volume estimates that have a significant uncertainty. The pumped riser open mode enables measurements with a higher degree of accuracy.

By switching from closed mode to open mode, and stopping flow into and out of the riser, any volume change in the well can be accurately determined by the level of mud in the riser 1 in static condition. The switching from closed to open mode can safely be done when the pressure in the riser above the RSD is higher than, lower than, or equal to, below the RSD. When switching between modes, care must be taken to stay within the allowable drilling window, usually given by pore and fracture pressures.

Also, during circulation, the open mode allows very rapid detection of gain or loss conditions in the well, by observing the riser level.

When operating in closed mode, the present invention allows for switching into the CML open mode by opening the valve 18 in the by-pass 17 or allowing communication between above and below the RSD 15 directly across the RSD 15. This allows for using the riser 1 as a tank to perform a flow-check or for any other reason use it to measure volume changes in the well in static conditions. The level in the riser may be set so that when the rig pumps are turned off, the pressures above and below the RSD 15 are different. For operational reasons it may not be desirable to open the by-pass unless the pressures above and below the RSD are close to equal. In this case the level in the riser needs to be changed. This change of level will take time.

As an alternative to the above, and also within the ambit of the invention, in going from closed to open mode and to use the riser as a tank to monitor the well and any change in volume, the mud return line 8 can be used as a tank to monitor the well. To use this line 8, it must be partially evacuated to the correct level to have the desired wellbore pressure. This can be accomplished by allowing the mud return line 8 to drain into the riser above or below the RSD 15 via the branch line 20 by opening the valve 22 or through the pump by-pass 11 by opening the valve 12 (or for the embodiment of FIG. 4, through the branch line 19 by opening the valve 21).

Since the return line 8 has a smaller diameter than the riser 1 any volume changes in the well will cause a larger change in the return line 8 level than it would have done in the riser 1. Consequently, it should be possible to obtain an even more accurate reading of volume changes using this method than using the riser 1 as a trip tank. Since the level changes more rapidly in the return line 8 than when using the riser 1, the pressure exerted on the well in case of an influx will increase rapidly as the level in the return line 8 increases. Since the diameter of the well in most cases, except when drilling very slim holes is larger than the diameter of the mud return line 8, the system will have a self-regulating effect towards stopping an influx.

As a second alternative to the above, the boost line 23 can be used as a tank to monitor the well. To use this line, the valve 25 must be opened, and pumping from the pump 41 has to be stopped. The level in boost line 23, and the associated pressure, will now equalize to the pressure in the riser below the RSD. The actual level in the boost line can at any time be verified by the boost line pressure sensor 72. Once the desired level is reached, the boost line can be used to monitor volume in the same manner as the open riser. For this purpose, boost line pressure sensor 72 could be used.

Reducing Wear on RSD by Reducing Differential Pressure

In closed mode, the pressure above the RSD 15 may be both equal to or lower than the pressure below the RSD, but may in certain operational modes also be kept higher than the pressure below the RSD. This ensures that any leaks across the RSD goes from above to below the RSD, and hence the pressure above the RSD is an additional safety measure against an uncontrolled flow of well fluids to surface.

However, the higher the differential pressure is across the RSD 15, the greater wear on the RSD. In order to reduce the wear, the differential pressure should be kept low.

The level/pressure sensors 29, 30 are used to monitor the pressure both below and above the RSD 15. The allowed pressure variation below the RSD 15 is given by the operational parameters of the well, which prescribes that the pressure in the well must be kept between certain limits, such as the fracturing pressure of the formation and the pore pressure of the formation, with associated safety margins. If the pressure difference across the RSD 15 exceeds a predetermined limit, the level of mud above the RSD 15 is reduced, either by opening the by-pass isolation valve 18 in a controlled (gradual) manner, or by adjusting the RSD to increase the leakage rate until the pressure difference is again below the predetermined limit.

If the pressure difference drops below a predetermined limit, the level of mud above the RSD 15 is raised by filling mud into the riser 1. This can conveniently be done be done through the fill-up line 26 or through the lower fill line 23 and branch line 31.

Monitoring Wear Condition of the RSD

As the RSD 15 is subject to wear during use, in particular due to the rotation of the drill string relative to the RSD, it must be replaced at intervals. Without any detection of the condition of the RSD it must be replaced at regular intervals based on expected lifetime of the RSD 15.

With the present invention it is possible to monitor the wear condition of the RSD 15, even when only one RSD 15 is used and without the need to externally supply a liquid. This is based on the fact that the leakage across the RSD increases as the RSD 15 wears. By monitoring the pressure below and pressure or level above the RSD 15 using the level/pressure sensors 29, 30 and keeping track of the flow of mud into and out of the well, as described above, it is possible with the system of the present invention, to monitor the leakage of mud across the RSD 15, and hence the wear of the RSD. The measured leakage rate may also be combined with measurements on the RSD such as e.g. hydraulic pressure or spring load on the RSD to determine wear status.

Reducing Wear on the RSD

As a further embodiment of the above monitoring of wear of the RSD 15, the system of the invention can also be used to reduce wear on the RSD 15.

It is known that the wear on the RSD depends on the friction between the drill string and the RSD, the higher the friction, the higher the wear. The friction depends among other factors on the force with which the RSD is set to have against the drill string. The higher this force is, the higher the friction will be. Despite the fact that a higher force and thereby higher friction results in an increased wear, the RSD is set with a relatively high force against the drill string. This is to avoid excessive leakage across the RSD.

With the present invention, the leakage across the RSD can be monitored. Hence, it is possible to allow a certain leakage as long as the leakage does not exceed a certain predetermined limit. By adjusting setting of the RSD to be near the maximum allowable leakage rate, the wear rate will be reduced, and the lifespan of the RSD will be increased.

Compensate for Increased Leakage Across the RSD

With the present invention there will be leakage over the RSD 15 in pumped riser closed mode. In at least one operational mode this leakage will be from above to below and will cause the level of drilling fluid in the riser to drop. This can be compensated for by filling mud into the riser to keep the level of mud above the RSD constant. In conventional drilling, filling of the riser will be done through the drill string or a boost line. However, with the set-up of the invention, this is not possible. The filling will therefore be done through the upper fill line 26 or the lower fill line 23 and branch line 31, which both end above the RSD.

With the present invention it is possible, using the monitoring of leakage described above, to determine the volume of mud that has to be filled into the riser above the RSD.

Compensation for increased leakage, such as caused by wear of the RSD, by increasing the force with which the RSD presses against the drill string can also be used. However, according to the invention, the level of mud above the RSD and the fill rate of the riser above the RSD is taken into account when determining the pressure with which the RSD presses against the drill string 4. According to the invention leakage can be compensated for both by the above filling of the riser with a controlled rate and by adjusting the pressure of the RSD against the drill string. Thereby the level of mud in the riser 1 above the RSD 15 can be maintained at a constant level. To this end the pump 27 and flow meter 28 are used. This process can be fully automized and controlled by an algorithm.

Stopping Leakage Across RSD

During certain operations, such as when circulating out a kick, or during connections (static) when operating with a pressure above the sealing element that is close to that below in dynamic conditions, but lower than below in static conditions, leakage across the RSD 15 is often not acceptable. In those cases, the leakage can be stopped or at least brought to within acceptable limits by increasing the force with which the RSD 15 presses against the drill string 4, so that it maintains a tight seal against the drill string. How the force from the RSD against the drill string 4 is increased will depend on the type of RSD and is as such not a part of the present invention. This procedure can be automated by using a controller.

Handling of Influx and Gas in the Mud

During normal operation, whether this is in closed or open mode, the mud in the well is returned via the return pump 7. However, if there is an influx of gas into the well, it is often not desirable to let the gas go through the pump. In that case the valves 9 and valves 10 are closed. Instead the valve 21 is opened to let the gas flow through the lower branch line 19 and up to the choke 13.

Alternatively, the influx may also be allowed to flow through the pump by-pass 11 to the choke Gas that comes up with the mud can accumulate below the RSD. To get rid of this gas without having it released in an uncontrolled fashion when the RSD 15 is opened or pulled, the bypass 17 is opened to allow a downwards flow of mud from above the RSD with the intention of flushing the gas downwards, through the pump 7 and up the mud return line 8 in a controlled manner. Depending on the conditions this may involve increasing the level above the RSD 15 to allow a higher speed of the pump 7 to create an increased downwards flow. At the same time the riser 1 is filled from the top above the RSD (as explained above). A substantial downward flow through the bypass 17 is thereby generated in the riser 1. The accumulated gas is entrained in the mud flow and flushed through the return pump 7. The flow continues up the return line 8. At the surface it can be routed to a mud/gas separator for safe handling of the gas.

When increasing the speed of the pump 7, and thereby reducing the pressure below the RSD 15, the pressure on the well will be reduced and the BOP may be closed to ensure the pressure in the well does not drop below acceptable limits. When closing the BOP, known methods for ensuring a high enough pressure below the BOP may be used, such as, e.g., opening the valve to the kill line which is filled with mud. The method by which the well below the BOP is kept above an acceptable level is not part of the present invention.

Preparing the Riser System for Retrofit

In some cases, the functionality of the RSD 15 and a possible additional closure device, such as an annular seal 16, may be existing in a riser joint intended for other drilling activities such as Surface Back Pressure (SBP) or Riser Gas Handling (RGH). For the system of the invention, the riser joint intended for these other activities could be used and could be modified to be controlled using the control system described above and some or all of the functionality of the system of the invention.

The riser joint intended for these other well activities could in addition be fitted with additional connections and equipment to facilitate a dual-purpose use as SBP or RGH and also as a portion of the system of the invention. The riser-joint intended for other operations would originally have its own control lines going to surface through an umbilical. In the present invention, it could be equipped with features that enable reconfiguration by adding lines and other hardware required for use as a portion of the system of the invention. Most notably would be re-configuration to allow the existing system to receive controls functionality from surface through umbilical of the added pumped riser equipment. Dual use of the riser joint could extend to including the facilities for mounting the riser pump 7 and associated pressure sensors 29 and outlet 6. These facilities could be optimized between the two uses.

Controlling Wellbore Pressure Using Both Choke and Pump

In some cases when operating this system, the total pressure, or ECD, in the wellbore with a full riser will be too high when circulating, but too low when not circulating. The pressure therefore needs to be controlled. Other effects such as cuttings loading may also contribute to needing to control the pressure. In such cases, pressure needs to be added when the mud column is static (i.e. there is no circulation) and the excess pressure needs to be removed when circulating. There are many reasons why the driller might need to control the pressure, and this operational mode may be a planned mode, it could be that the mud weight has changed beyond what was expected during operation, it could be that the wellbore conditions have changed, such as when drilling into a pressure ramp, where the pore pressure suddenly is increased, or many other reasons. At any rate, the driller may want to control the downhole pressure in such situations using the choke, the pump or a combination of both.

Controlling the downhole pressure in closed mode using the choke or the pump alone is known from prior art. For some cases, however, it might be that the driller wants to switch between adding and removing pressure. The terms adding and removing pressure here is relative to the pressure which would have neen the case with an open riser full of mud. In order for this to be operationally efficient and safe, the transition between adding and removing pressure should be seamless. There are many operational scenarios where this could be relevant. Two examples are mentioned below.

When making a connection, circulation is stopped, and hence the dynamic component of the ECD is removed. The downhole pressure drops, as the there is no flow through the annulus. This pressure drop needs to be compensated for by increasing the riser pressure as the rig pumps are ramped down and reducing the riser pressure as the rig pumps are ramped up. When operating the system in a mode where pressure is removed, the driller may experience a kick that needs to be circulated out. During such a process, additional pressure needs to be applied to the system during the circulation process to account for the low density of gas being circulated out. This concept and the methods by which a kick is dealt with is known to the person skilled in the art. For certain combinations of mud weights and kick size, the driller will need to add pressure at the start of kick circulation and remove pressure at the end of the kick circulation.

For such cases, the driller can operate the system of FIG. 4, 5 or 6 by operating the pump 7 and the choke 13, 113 simultaneously and in series, where the pump removes pressure and the choke adds pressure. By regulating the speed of the pump and the opening of the choke in a controlled manner, any negative or positive pressure, within the physical constraints of the operation, can be created within seconds.

During this process, at a point where the choke is adding more pressure than the pump is removing, the driller may opt to isolate the pump by closing valves 9 and 10 and opening valve 12. This would be particularly relevant if the system pressure is approaching the pressure rating of the pump, or if it is suspected that gas in quantities that could affect system operation may enter the pump. Although it is possible to control the operation of the system manually by the driller, the system will typically be set up with an automated control system with the choke and pump in a Master-Slave configuration, using sensor readings to maintain the desired wellbore pressure. Such control systems for controlling the wellbore pressure in general are common for Surface Back Pressure operations. Adding the control of the subsea pump and the compressibility of the mud in the return line to such control system, and automating the closing of pump isolation valves and opening of pump by-pass valves is per se well known to a person skilled in the art of control systems.

Changing the Riser Level or Changing Out the Mud Above the RSD

During operation with a closed system, the driller may want to make changes to the mud in the riser above the closed RSD 15. There are many reasons why the driller may want to do this. In the following a few examples are mentioned. It may be that the driller wants to open the RSD 15 and that the current mud level above is too high. It may be that the driller wants a higher mud weight in the upper part of the riser. It may be that there are cuttings in the upper part of the riser that the driller wants to remove.

With the system in closed mode and the riser outlet 6 isolated, the upper riser suction line 550 is used to draw suction from the riser. The top-fill pump, or the boost line may be used at the same time to fill into the upper riser. This will obviously facilitate an alteration of the mud level or a replacement of the mud.

By altering the mud weight, the riser level or a combination of both above the RSD 15, the upper riser pressure can be controlled. In other drilling operations, the concept of a Riser Cap is well-known, where the kill, choke line or boost line is used to alter the mud weight in the riser to create a system with 2 mud weights, typically to add pressure to the wellbore. For such systems, the driller cannot circulate down the drillstring and maintain the Riser Cap intact. In the present system, by using the outlet below the RSD 15, the driller will be able to circulate down the drillstring and up the annulus and at the same time maintain the Upper Riser Cap intact without diluting it with mud from the annulus. With a heavy mud on top, there will be a tendency for the heavier mud to migrate down and mix with the lighter mud below, but this can be managed by only allowing a small opening through or past the RSD 15, which is large enough to give full pressure communication, but low enough to allow only a very limited flow past. A leakage rate from above to below in the order of 1-50 litres per minutes will be achievable, and this can easily be managed by the driller.

During drilling, gas may have accumulated below the RSD 15. If the downhole pressures allow, the upper riser mud level may be lowered prior to opening the RSD as a safety precaution should any gas migrate up the riser.

When handling a kick, there will be a period during the kick circulation where there is gas just below the RSD 15. In order to avoid problems if a blockage in the return line should occur at such a time, the system may be fitted with an over-pressure protection system that acts as a by-pass across the RSD and allow the pressurized gas to enter the upper riser. To reduce the risk of negative consequences of such an event, the upper riser suction line 550 can be used to reduce the riser level. The upper riser will then act as a tall separator with distance from the liquid level to surface that is much higher than what is achievable for a conventional separator. This will reduce the risk of a riser unloading event.

Operating in Open Mode—Quickly Reverting to Closed Mode

It is foreseen that the main operation of this invention, except for the modes described in FIG. 6, will be to operate the system in open mode, but on regular, or irregular, intervals switch to closed mode. The switch to closed mode may be planned such as to trap pressure on connections, or unplanned such as when taking a kick where it will be desired to very quickly revert to an over-balanced condition. The pressure needed may be at a level that can be managed by the pump alone, or it may be that also a choke pressure will need to be added, potentially requiring the pump and choke to operate in series. Such an operation has been described in detail above.

When operating in open mode with the RSD in place, the driller can quickly convert to a closed mode by closing the by-pass isolation valve, or close the RSD itself, depending on the design of the RSD. Closing the by-pass valve can be done in 1 to 5 seconds. The RSD can also be set up to close in 1 to 5 seconds. For the driller, going from open to closed in 1 to 5 seconds is very rapid and will not pose any operational constraints. With this unique feature, the driller can utilize all the benefits of an open CML system while at the same time always having the ability to quickly convert to a closed system to use the efficiency or safety features of a closed system.

Using By-Pass or RSD as Choke Device for Casing Shoe Protection

When operating in closed mode, the riser pressure, and by continuation the downhole pressure increases due to blockage, wrong operation of equipment or similar. In such a case, the pressure at the casing shoe may get above fracture pressure and the formation may break down, leading to severe losses. To prevent this, the RSD bypass line isolation valve, or the RSD itself if the design allows by reducing pre-load, could be used as a simple choke to allow riser pressure to be released in a controlled fashion prior to breaking down the casing shoe. The accuracy of the choking effect will not be of the quality that can be achieved with a regular drilling choke, but that will be acceptable to the driller as the main objective will be to use the choking effect to avoid breaking down the casing shoe, but to do so in a controlled fashion, rather than quickly releasing pressure, which could have detrimental effects as the pressure could get below pore pressure. If the by-pass isolation valve is a ball-valve, a person skilled in the art will know how to partially open such a valve to act as a choke. Seeing as the normal mode of operation with the present invention is to operate with a reduced riser level with a significant height up to the drilling rig, fluids could in many instances safely be bypassed to the riser above the RSD. Operating a closed riser system intentionally with a reduced riser level is not described in prior art.

Calculating and Compensating for Temperature Induced Density Effects When Not Drilling on Bottom When pulling out of hole, particularly on high temperature wells, the drilling mud in the annulus will be heated by the formation. As an effect of the heating, the density will drop and the volume of the mud in the hole will increase. By operating with a reduced riser level in open mode using the riser as a trip tank, the volume change of mud in the wellbore can be constantly monitored. Any equipment being run in or out of the well will have a volume that can be pre-measured and accounted for in the mud volume measurements. Since the volume of each piece of equipment is very accurately known and also the well geometry and dimensions, the change in volume can be used to calculate the change in overall density. The temperature in the formations into which the well is being drilled are either known, can be measured during drilling, or estimated. Based on this, a temperature profile of the mud in the well can be calculated. By combining temperature measurements or estimates with known physical properties of the mud and well geometry, the change in temperature profile over time when not circulating down the drillstring can be calculated. The change in downhole temperatures will cause the density of the mud to drop as it is heated, which in turn will result in a volume expansion of the mud in the well and an associated pressure drop. The expanded volume will expand from the well with a smaller diameter into a riser with a larger diameter, so the net effect will be a drop in wellbore pressure. Based on the known properties of the mud, the volume measurements and observations or predictions on formation temperatures and associated downhole temperature profiles of the mud in the well, the temperature-induced wellbore pressure drop can be calculated. In order to compensate for this drop in wellbore pressure, the level of mud in the riser can be increased to achieve a near-constant wellbore pressure.

Should a sudden influx occur during this process, other methods described herein can be used to close the riser to handle the influx safely.

The invention claimed is:

1. A riser arrangement for performing operations, in a well extending from a bottom of a body of water, the riser arrangement comprising:

a riser;

a choke line coupled to the riser at a blowout preventer ("BOP") in the riser;

the riser having a return outlet to a subsea return pump at a location substantially below a surface of the body of water, the subsea return pump being coupled to a return line to pump fluids from the riser to above the surface of the body of water;

the return line being a separate line, at least one sealing element being arranged within the riser at a location above the return outlet;

wherein a bypass is arranged to bypass the sealing element, the bypass extending from a port at the riser below the sealing element to a port at the riser above the sealing element, the bypass being equipped with at least one isolation valve that is selectively controllable;

the return line being coupled to a choke downstream of the subsea return pump; and wherein a riser insert, with a substantially smaller flow capacity than the riser, is arranged above the sealing element.

2. The riser arrangement of claim 1, wherein the bypass extends from below the sealing element to above the riser insert.

3. A method of performing operations, in a well extending from a bottom of a body of water, the method comprising:

providing a riser having a return outlet to be coupled to a return pump, the return pump being adapted to pump fluid from the riser to above a surface of the body of water;

positioning a sealing element in the riser above the return outlet;

providing a bypass around the sealing element;

operating in a closed mode where the sealing element and the bypass are essentially closed to prevent flow therethrough;

operating with drilling fluid level reduced to below a slip joint in the riser above the sealing element;

operating the return pump to reduce pressure below the sealing element; and switching to an open mode by selectively opening the bypass to allow flow between the riser below the sealing element and the riser above the sealing element.

4. The method of claim 3, comprising the step of preparing to switch to an open mode by decreasing or increasing the pressure below the sealing element until pressures above the sealing element and below the sealing element are substantially the same.

5. The method of claim 3, comprising the step of controlling the pressure in the well by adjusting a level of liquid in the riser using the return pump.

6. The method of claim 3, wherein the pressure in the riser below the sealing element is monitored by a pressure sensor.

7. The method of claim 3, wherein a level in the riser above the sealing element is monitored by a level sensor or a pressure sensor.

8. A method of measuring changes in liquid volume in a well extending from a bottom of a body of water, the method comprising:

providing a riser having a return outlet to be coupled to a return pump, the return pump being adapted to pump fluid from the riser to above a surface of the body of water;

positioning a sealing element in the riser above the return outlet;

providing a bypass around the sealing element;

operating in a closed mode where the sealing element and the bypass are essentially closed to prevent flow therethrough;

switching to an open mode by opening the bypass to allow flow between the riser below the sealing element and the riser above the sealing element;

essentially stopping circulation of liquid in the well;

measuring a level of liquid in the riser over a period of time; and determining changes in volume of liquid in the well based on the level measurements.

9. The method of claim 8, comprising the step of preparing to switch to an open mode by reducing or increasing a level of liquid in the riser above the sealing element until pressures above the sealing element and below the sealing element are substantially the same.

* * * * *